US008220119B2

(12) United States Patent
Burlage et al.

(10) Patent No.: US 8,220,119 B2
(45) Date of Patent: Jul. 17, 2012

(54) MEMORIALIZATION CASKET AND METHOD

(75) Inventors: Jason Burlage, Batesville, IN (US); Paul Holzman, Mason, OH (US); Jancy A. Motz, Fishers, IN (US); Ilija Rojdev, Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 292 days.

(21) Appl. No.: 12/605,073

(22) Filed: Oct. 23, 2009

(65) Prior Publication Data

US 2010/0299895 A1 Dec. 2, 2010

Related U.S. Application Data

(60) Provisional application No. 61/181,032, filed on May 26, 2009.

(51) Int. Cl.
*A61G 17/00* (2006.01)

(52) U.S. Cl. ..... 27/14; 27/19

(58) Field of Classification Search ..... 27/19, 14, 27/2, 10, 15, 16; 40/124.5, 600, 621; 428/542.4; D99/8, 10, 13

See application file for complete search history.

(56) References Cited

U.S. PATENT DOCUMENTS

| | | | | |
|---|---|---|---|---|
| 2,712,191 | A | 7/1955 | Hillenbrand | |
| 3,115,434 | A * | 12/1963 | Hahn | 428/3 |
| 6,237,202 | B1 | 5/2001 | Agee et al. | |
| 6,446,315 | B2 | 9/2002 | Agee et al. | |
| 6,557,222 | B2 | 5/2003 | Groemminger et al. | |
| 6,591,466 | B1 | 7/2003 | Acton et al. | |
| 6,691,385 | B2 | 2/2004 | Bell et al. | |
| 6,883,212 | B2 | 4/2005 | Groemminger et al. | |
| 6,928,706 | B2 | 8/2005 | Acton et al. | |
| 7,210,204 | B2 | 5/2007 | Groemminger et al. | |
| 7,340,810 | B2 | 3/2008 | Acton et al. | |
| 7,591,052 | B2 * | 9/2009 | Bovard et al. | 27/10 |

* cited by examiner

*Primary Examiner* — William L. Miller
(74) *Attorney, Agent, or Firm* — Wood, Herron & Evans, LLP

(57) ABSTRACT

A casket comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel, and at least one medallion mounted on either an interior surface or an exterior surface of either the cap or the shell, the medallion having text and/or graphics representing a life aspect of the deceased.

14 Claims, 23 Drawing Sheets

MEMORIALIZATION CASKET AND METHOD

RELATED APPLICATIONS

This application claims the benefit of U.S. Provisional Patent Application Ser. No. 61/181,032 filed May 26, 2009 for MEMORIALIZATION CASKET AND METHOD, hereby incorporated by reference herein as if fully set forth in its entirety.

FIELD

The subject matter herein relates generally to caskets and more particularly to caskets having memorialization features and to methods of memorializing the deceased.

BACKGROUND

When an individual passes away it is customary for the body of the individual to be viewed by family and friends at a funeral home. After the viewing, a funeral or other memorial service is generally held at the funeral home or a church to commemorate the life of the deceased. Thereafter, a grave side service may be held with family and friends looking on. With the completion of the grave side service the casket is lowered into the grave where it will remain. A similar service may be held prior to or after the deceased is cremated. Usually after cremation the cremated remains are collected and presented to the family in a cremation urn.

The casket in which the deceased is displayed can be customized to fit the needs and preferences of the deceased and the family. For instance, a wide variety of materials, finishes, colors and decorative ornamentation can be chosen to meet these needs. The purchaser of a casket can also customize the casket using a variety of interchangeable stylized trim, for example, corner ornaments. The purchaser may select from a number of stylized corner ornaments each of which has been ornamented to represent a "theme." The purchaser thus selects a corner ornament design having a theme representative of an aspect of the deceased's life to personalize the casket, for example, a golf corner ornament design could be selected for installation on the casket to reflect that the deceased was an avid golfer.

Once the casket is buried or the deceased is cremated and the funeral or other memorial service is completed, the families are left with few tangible reminders of the funeral or memorial service. Most families receive flowers at the funeral home which pay respect to the deceased and his or her surviving family. These flowers, however, wilt and die after a short time, leaving the family with few remembrances of the funeral or memorial service. It is desirable for the families to receive a more tangible and permanent reminder of the funeral or memorial service.

Prior solutions to this need may be seen in the quick change casket ornament of the assignee's U.S. Pat. Nos. 7,340,810, 6,928,706, and 6,591,466, which may be removed from the casket and mounted on either the plaque of the assignee's U.S. Pat. Nos. 7,210,204, 6,883,212, and 6,557,222 or the pedestal of the assignee's U.S. Pat. No. 6,691,385 and presented to a family member or loved one of the deceased. All of these patents are hereby incorporated by reference herein as if fully set forth in their entirety.

Further innovation in providing families with tangible and permanent reminders of the funeral or memorial service and of their deceased loved one is desired.

SUMMARY

In one aspect, a casket comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel, and at least one medallion mounted on either an interior surface or an exterior surface of either the cap or the shell, the medallion having text/or graphics representing a life aspect of the deceased.

The medallion can be mounted in a recess in the cap panel or in a recess in the exterior surface of the cap. The recess can have a circumferential shape that matches a circumferential shape of the medallion. The circumferential shapes of the recess and the medallion can be circular, for example. Four medallions can each be mounted in a respective recess, and the recesses can be formed in the cap panel such that the medallions mounted therein are arranged in an arcuate pattern. The medallion can be mounted in the recess with double sided tape, hook and loop fastener, adhesive, magnets, or by a press-fit. A reduced scale medallion corresponding to the medallion can be provided with the casket. The reduced scale medallion can have substantially the same shape, text, and graphics of the medallion. The reduced scale medallion can be sized to fit in a pocket of an article of clothing worn by a loved one of the deceased so as to be conveniently carried by the loved one as a keepsake representing the life of the deceased. For example, the reduced scale medallion can be about the size and shape of a coin.

In another aspect, a method of memorializing a deceased comprises the steps of displaying the deceased in a casket having a cap and a shell and further having at least one medallion mounted on one of an interior surface of one of the cap and the shell and an exterior surface of one of the cap and the shell, the medallion having at least one of text and graphics representing a life aspect of the deceased, and presenting a survivor of the deceased with a reduced scale medallion corresponding to the medallion, the reduced scale medallion having substantially the same shape, text, and graphics of the medallion, the reduced scale medallion being sized to fit in a pocket of an article of clothing worn by the survivor of the deceased.

The reduced scale medallion can be about the size and shape of a coin. The cap can include a dish assembly mounted to an underside of the cap, the dish assembly including a cap panel, and the medallion can be mounted in a recess in the cap panel; alternatively, the medallion can be mounted in a recess in the exterior surface of the cap. The reduced scale medallion can be engraved on its rear side with the name and birth and death dates of the deceased, prior to being presented to the survivor.

In yet another aspect, a method of memorializing a deceased comprising the steps of displaying the deceased in a casket having a cap and a shell and further having at least one medallion mounted on one of an interior surface of one of the cap and the shell and an exterior surface of one of the cap and the shell, the medallion having at least one of text and graphics representing a life aspect of the deceased, and presenting a survivor of the deceased with a keepsake medallion having substantially the same size, shape, text, and graphics of the medallion mounted to the casket.

The medallion mounted to the casket can be removed and presented to the survivor as the keepsake medallion, or a facsimile of the medallion mounted to the casket can be presented as the keepsake medallion.

The medallion can be mounted in a receptacle mounted to the cap panel. The receptacle can comprise a circular holder having a plurality of resilient tabs spaced circumferentially around the holder; the medallion can be circular and have a plurality of indents spaced circumferentially around the medallion which receive the resilient tabs. The receptacle can comprise a circular holder having a plurality of spring loaded ball bearings spaced circumferentially around the holder; the medallion can be circular and have a plurality of indents spaced circumferentially around the medallion which receive the spring loaded ball bearings. The receptacle can comprise a circular holder having a plurality of resilient tabs spaced circumferentially around the holder; the medallion can be circular and have a plurality of slots and detented surfaces spaced circumferentially around the medallion; the medallion can be loaded by aligning the slots with the tabs, inserting the medallion into the holder, and rotating the medallion relative to the holder such that the tabs move over the detented surfaces. The receptacle can comprise a circular holder and a transparent cover hinged to the holder. The receptacle can comprise a resilient circular holder having a female fastener component and a back piece having a male fastener component; the medallion can be a snap-fit in the resilient circular holder. The receptacle can be a decorative strip including an aperture through which the medallion is visible; the medallion can be installed behind the strip so as to be visible through the aperture. The receptacle can be a circular recess formed in the cap panel and the medallion can be a press-fit in the recess. The receptacle can be a transparent sleeve into which the medallion is slipped. The receptacle can be a frame having a transparent front; the medallion can be slipped behind the transparent front from a top of the frame. The medallion can include a ribbon attached thereto; the ribbon can be attached to a lower puffing of the dish assembly. The medallion can be mounted in a frame which is removably attached to the cap panel. The frame can have means on a rear side thereof to stand the frame on a surface for display. The receptacle can be a circular holder to which is threadably attached a transparent lens.

In another aspect, a casket comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel, the cap panel comprising a sheet of magnetic material, and at least one medallion having a magnet on a rear side mounted on the cap panel, the medallion having at least one of text and graphics representing a life aspect of the deceased.

The dish assembly can include puffing members mounted around a periphery thereof. The cap panel can further comprise a cardboard or chipboard backing sheet, the sheet of magnetic material being placed on top of the backing sheet. The cap panel can further comprise decorative fabric covering the magnetic sheet. The magnetic material sheet can cover substantially an entire surface area bounded by the puffing members.

In another aspect, a casket comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel and puffing members mounted around a periphery of the cap panel, the cap panel comprising a sheet of magnetic material, and at least magnetic ornament on the cap panel.

The magnetic material sheet can cover substantially an entire surface area bounded by the puffing members. The cap panel can further comprise a cardboard or chipboard backing sheet, the sheet of magnetic material being placed on top of the backing sheet, and the cap panel can further comprise decorative fabric covering the magnetic sheet.

DRAWINGS

DESCRIPTION

Figure 1:
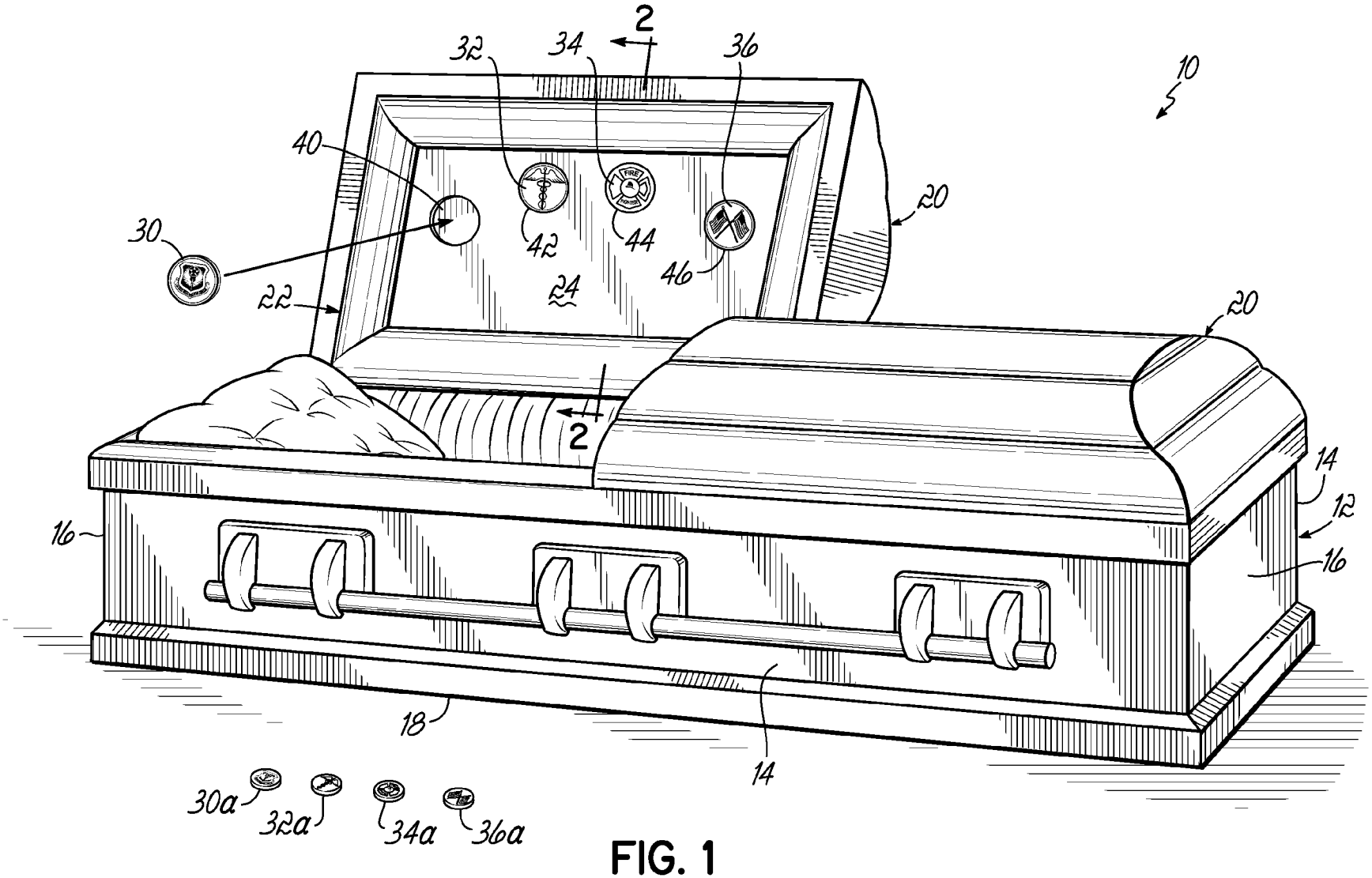
FIG. 1 is a perspective view of our casket.

Referring to FIG. 1, a casket 10 has a shell 12 adapted to receive the remains of a deceased having a pair of side walls 14, 14, a pair of end walls 16, 16, and a bottom wall 18, and a cap 20 closable on the shell 12. The casket may have a pair of caps or a single cap the full length of the casket. Cap 20 has an ornamental dish assembly 22 mounted to an underside of the cap 20. The dish assembly 22 includes a cap panel 24. At least one medallion 30 is mounted on either an interior surface or an exterior surface of either the shell 12 or cap 20. The medallion 30 has text/or graphics representing a life aspect of the deceased, for example, Father, Brother, Husband, Lawyer, Christian, Hunter, Fisherman, etc. and may be fabricated of a metallic or non-metallic material.

Figure 2:
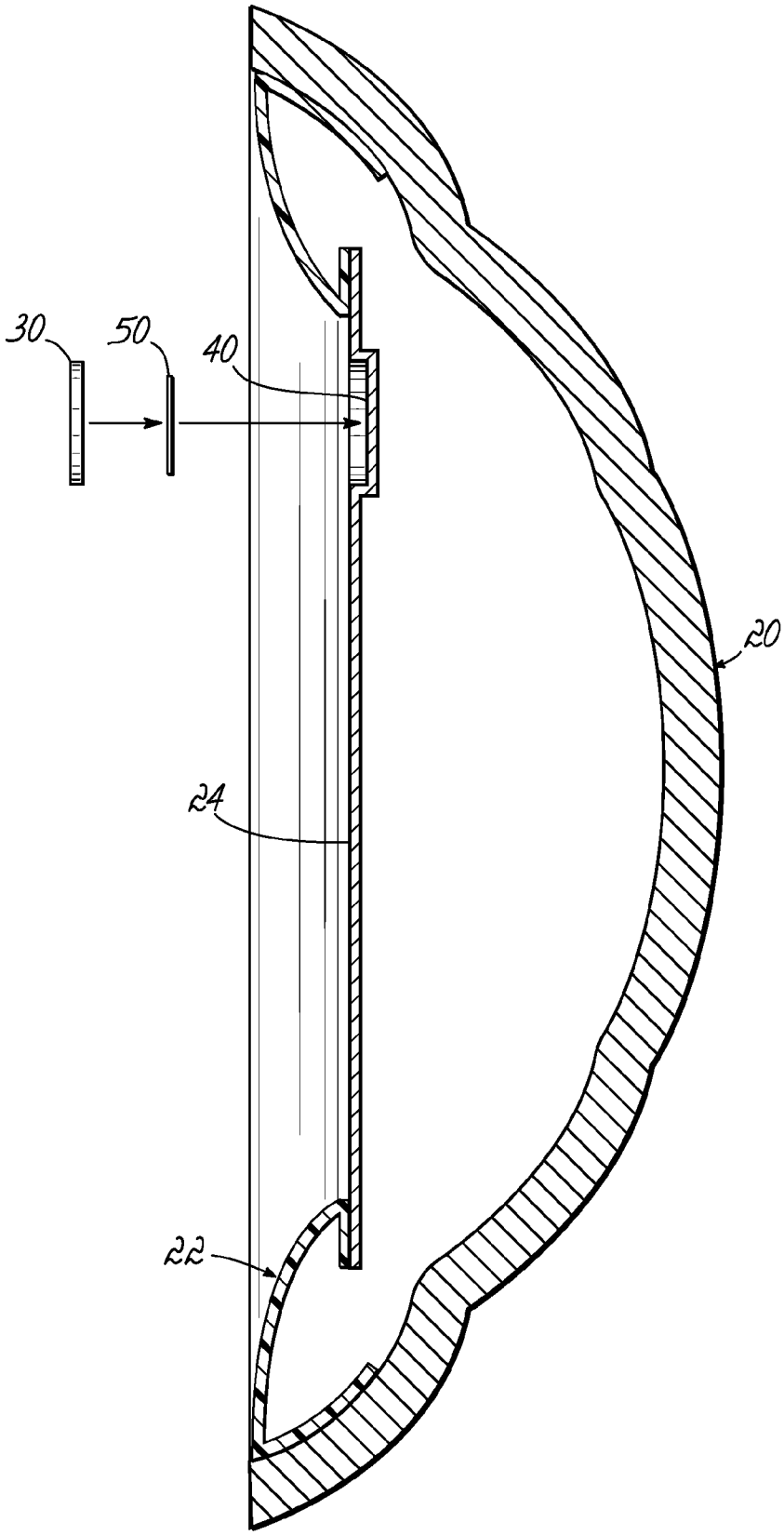
FIG. 2 is a disassembled cross-sectional view taken along line 2-2 of FIG. 1.
Figure 3:
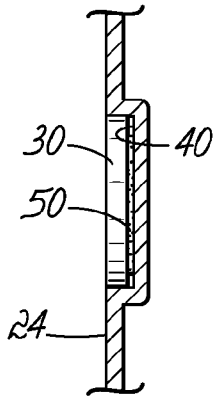
FIG. 3 is an enlarged assembled view of a portion of FIG. 2.
Figure 4:
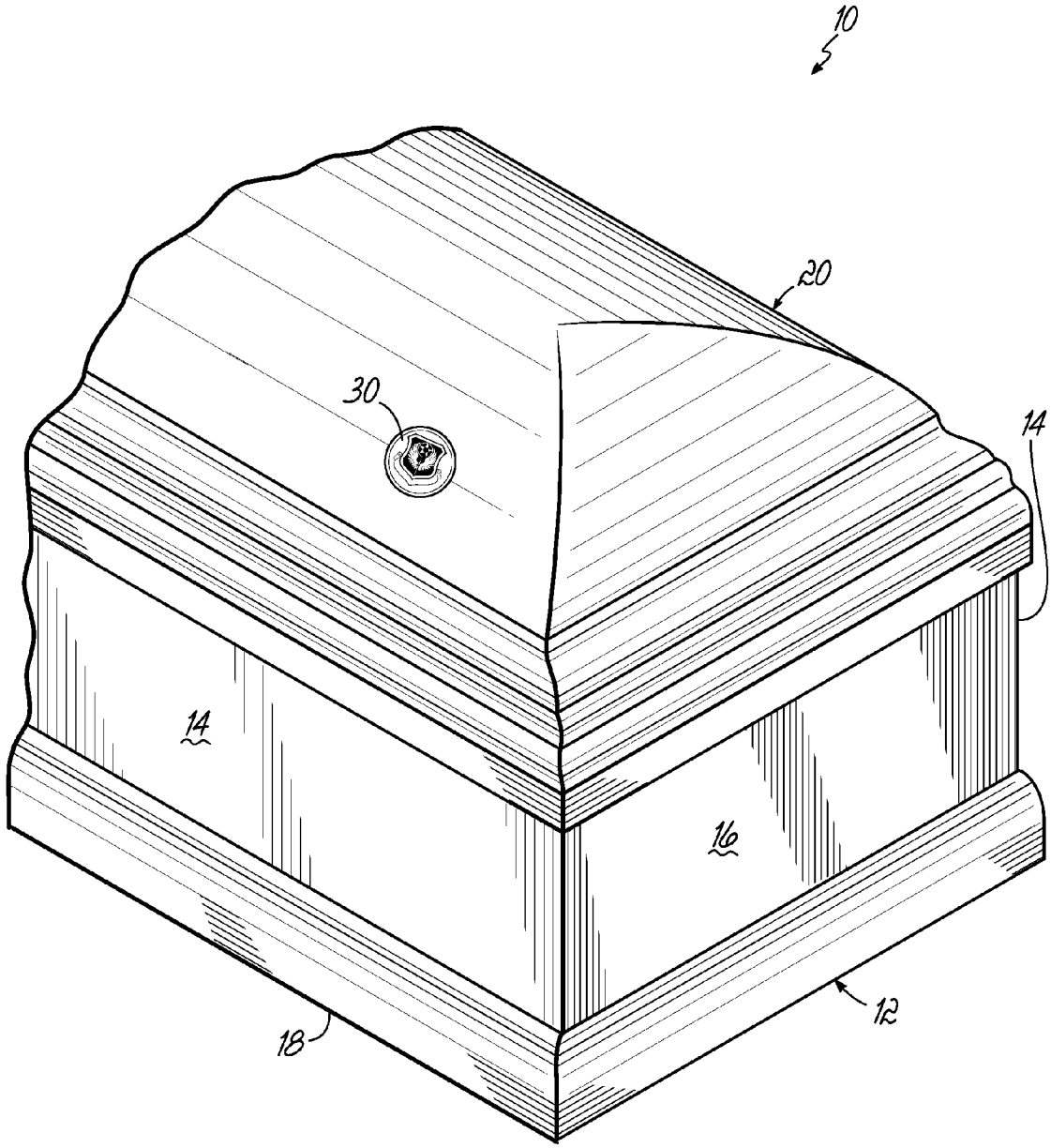
FIG. 4 is a partial perspective view of another embodiment of our casket.

As shown in FIGS. 1-3, the medallion 30 can be mounted in a recess 40 in the cap panel 24, for example. As another example, the medallion 30 can be mounted in a recess (not shown) in an exterior surface of the cap 20, as shown in FIG. 4. The recess 40 can have a circumferential shape that matches a circumferential shape of the medallion 30. The circumferential shapes of the recess 40 and the medallion 30 can be circular, for example, as illustrated.

Four medallions 30, 32, 34, 36 can be mounted in respective recesses 40, 42, 44, 46. The recesses 40, 42, 44, 46 can be formed in the cap panel 24 such that the medallions 30, 32, 34, 36 mounted therein are arranged in an arcuate pattern, as shown in FIG. 1. The medallion(s) can be mounted in the recess with a fastener 50 such as double sided tape, hook and loop fastener, adhesive, magnets, or simply by a press-fit. Outfitting the casket 10 with plural themed medallions 30, 32, 34, 36 permits plural life roles of the deceased to be displayed and celebrated instead of only a single life role per current casket personalization.

Reduced scale medallions 30*a*, 32*a*, 34*a*, 36*a* can be supplied or provided with the casket 10. The reduced scale medallions 30*a*, 32*a*, 34*a*, 36*a* correspond to the full size medallions 30, 32, 34, 36 in that they have substantially the same shape, text, and graphics of the full size medallions 30*a*, 32*a*, 34*a*, 36*a*. However, the reduced scale medallions 30*a*, 32*a*, 34*a*, 36*a* are sized to fit in a pocket of an article of clothing worn by a surviving loved one of the deceased. For example, the reduced size medallions can be about the size and shape of a coin permitting easy carry in a pocket, purse, etc.

In use, the funeral director displays the deceased in a casket 10 having at least one medallion 30 mounted as described above. Subsequent to the viewing, the funeral director presents the substantially identical reduced size medallion 30*a* to the survivor of the deceased for carry in a pocket or purse as a keepsake and reminder of the life of the deceased. Prior to the funeral director presenting the medallion 30*a* to the survivor, it can be engraved on its rear side with the name and birth and death dates of the deceased.

Figure 5A:
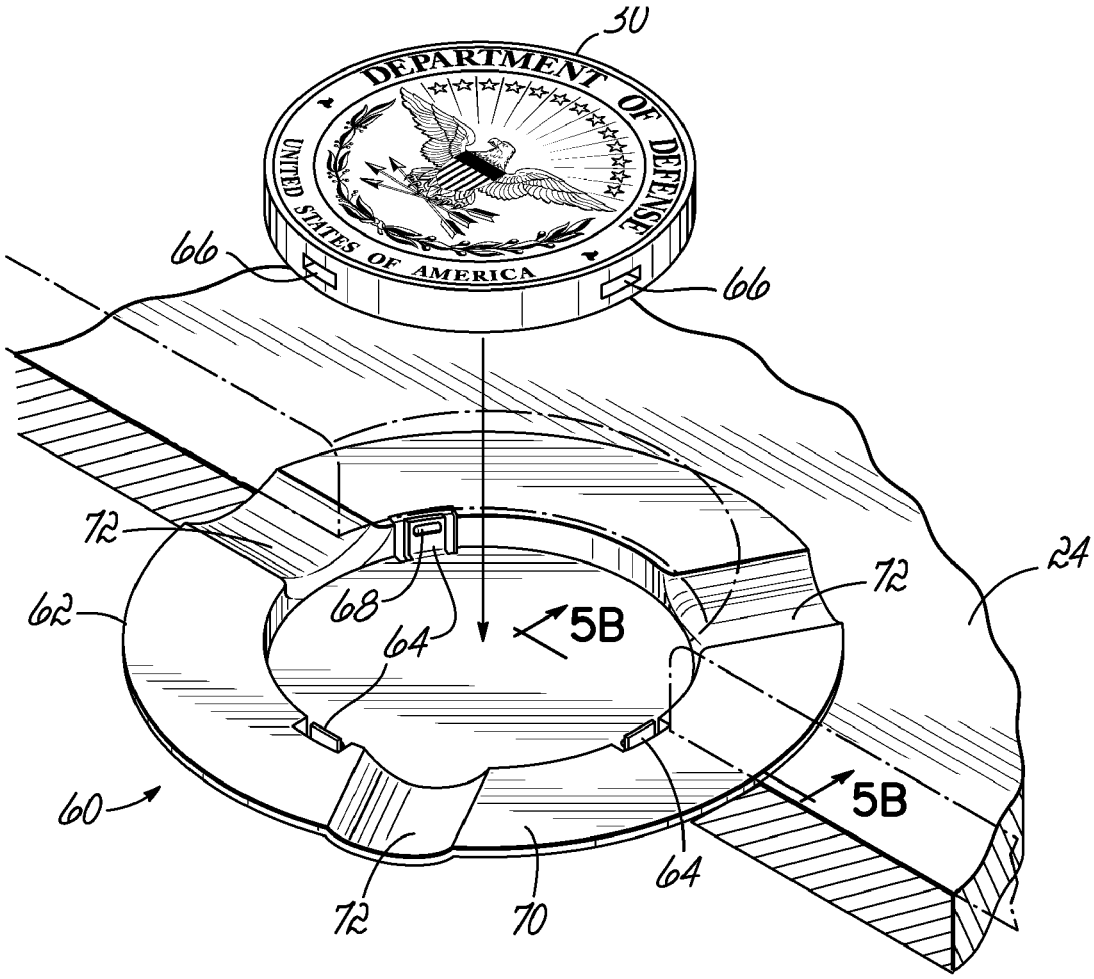
FIGS. 5A and 5B are exploded and assembled partial perspective views, respectively, of another embodiment of our casket.
Figure 5B:
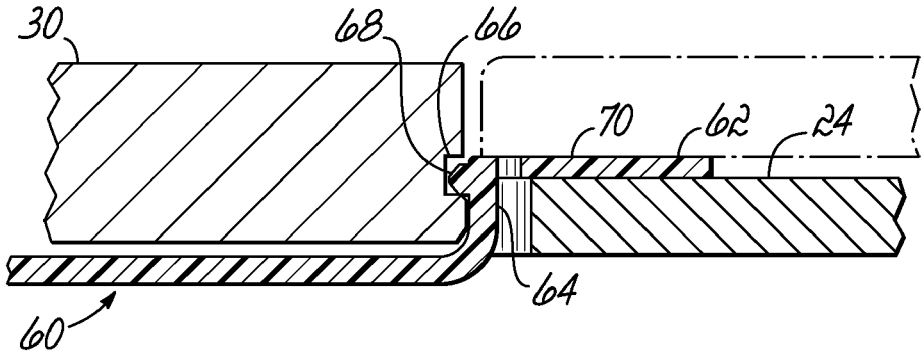

FIGS. 5A-22 illustrate various alternative embodiments of the invention. Referring to FIGS. 5A and 5B, the medallion 30 is mounted in a receptacle 60 which is mounted to the cap panel 24. The receptacle 60 can comprise a circular holder 62 having a plurality of resilient tabs 64 spaced circumferentially around the holder 62. The medallion 30 can be circular and can have a plurality of indents 66 spaced circumferentially around the medallion 30 which receive detents 68 on the resilient tabs 64. The holder 62 can have a circular flange 70 including one or more finger grooves 72 spaced circumferentially around the flange 70 to facilitate the placement and removal of the medallion 30 into and out of the holder 62.

Figure 6A:
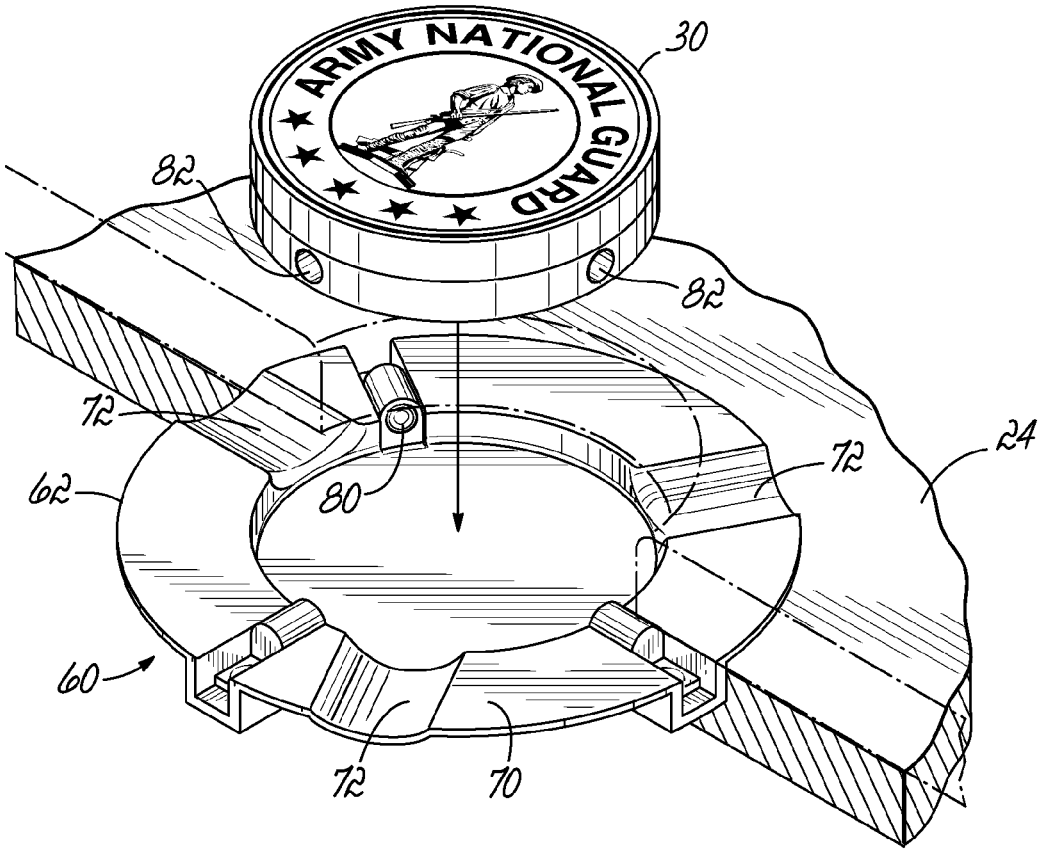
FIGS. 6A and 6B are exploded and assembled partial perspective views, respectively, of another embodiment of our casket.
Figure 6B:
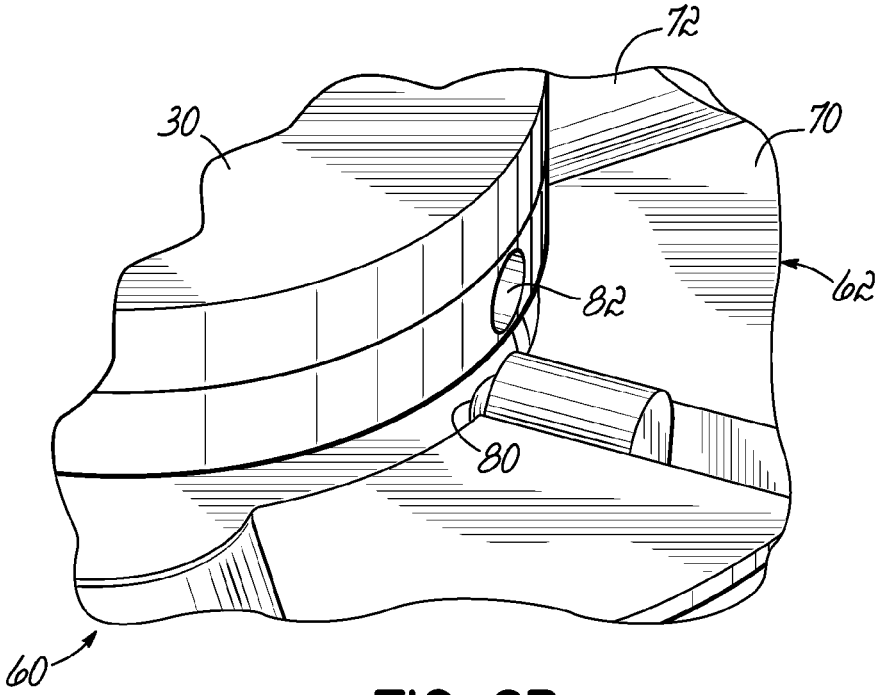

Referring to FIGS. 6A and 6B, the circular holder 62 can have a plurality of spring loaded ball bearings or so-called ball detents 80 spaced circumferentially around the holder 62. The medallion 30 can be circular and can have a plurality of indents 82 spaced circumferentially around the medallion 30 which receive the spring loaded ball bearings 80.

Figure 7A:
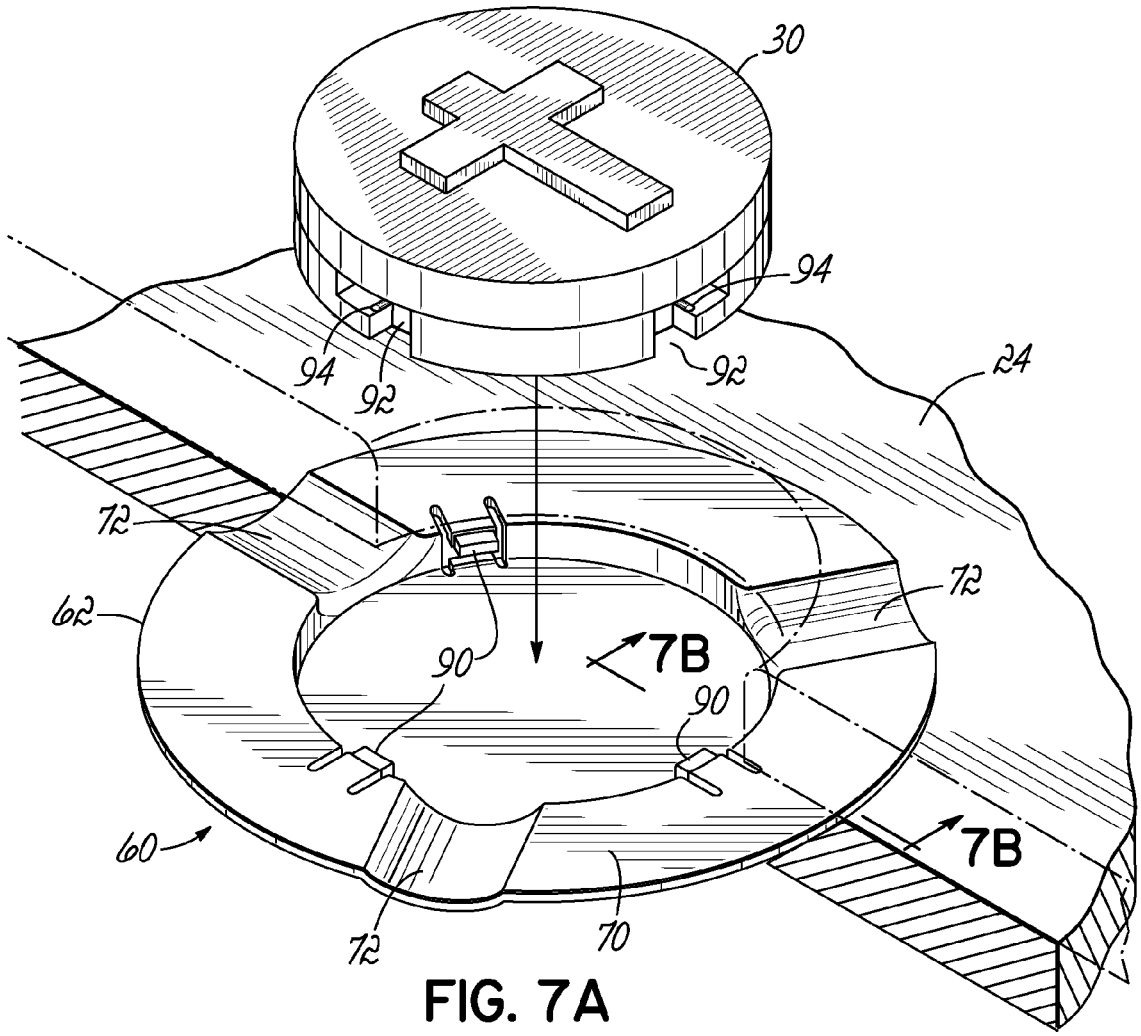
FIGS. 7A and 7B are exploded and assembled partial perspective views, respectively, of another embodiment of our casket.
Figure 7B:
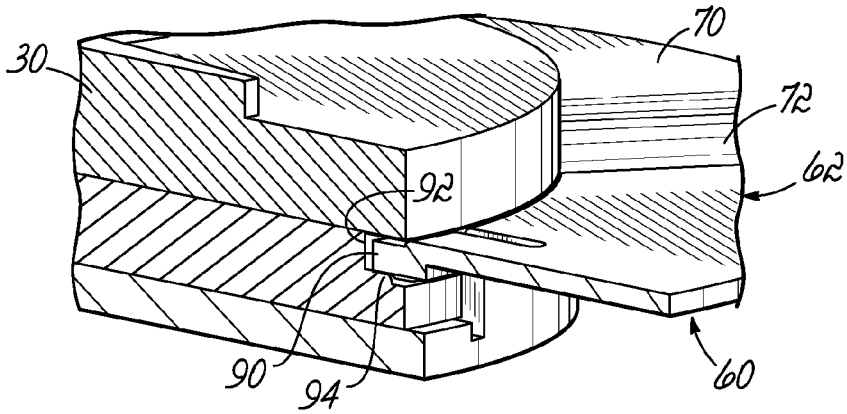

Referring to FIGS. 7A and 7B, the circular holder 62 can have a plurality of resilient tabs 90 spaced circumferentially around the holder 62. The medallion 30 can be circular and can have a plurality of right angle slots 92 and detented surfaces 94 spaced circumferentially around the medallion 30. The medallion 30 is loaded by aligning the slots 92 with the tabs 90, inserting the medallion 30 into the holder 62, and rotating the medallion 30 relative to the holder 62 such that the tabs 90 move over the detented surfaces 94.

Figure 8A:
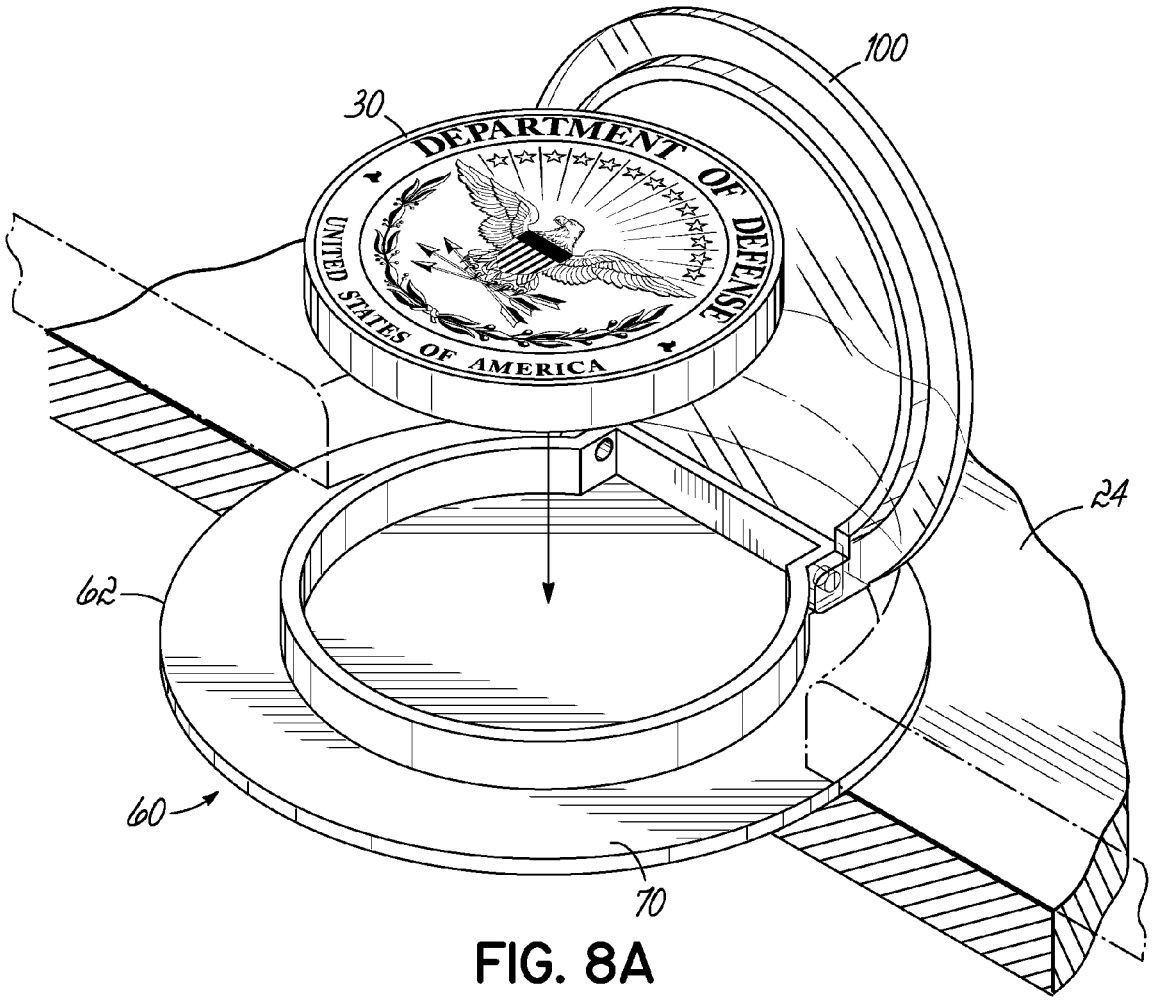
FIGS. 8A and 8B are exploded and assembled partial perspective views, respectively, of another embodiment of our casket.
Figure 8B:
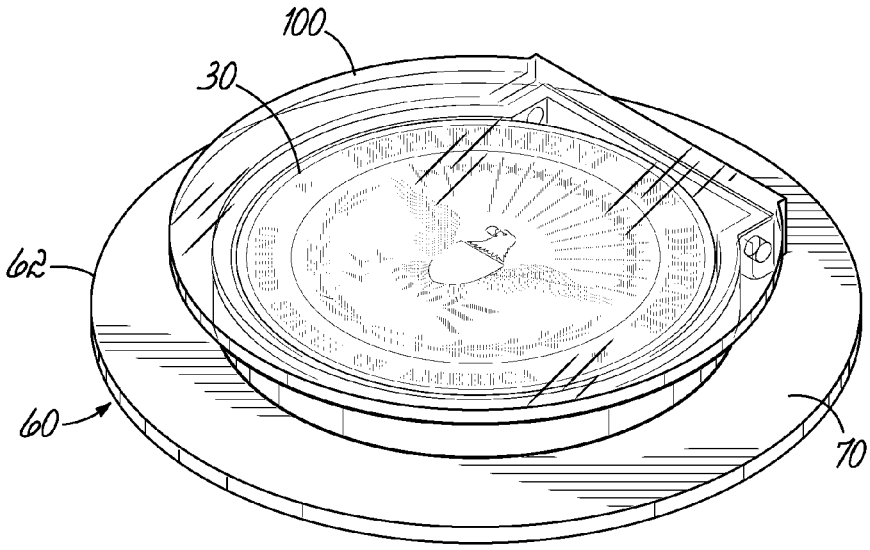

Referring to FIGS. 8A and 8B, the circular holder 62 can have and a transparent cover 100 hinged to the holder 62.

Figure 9A:
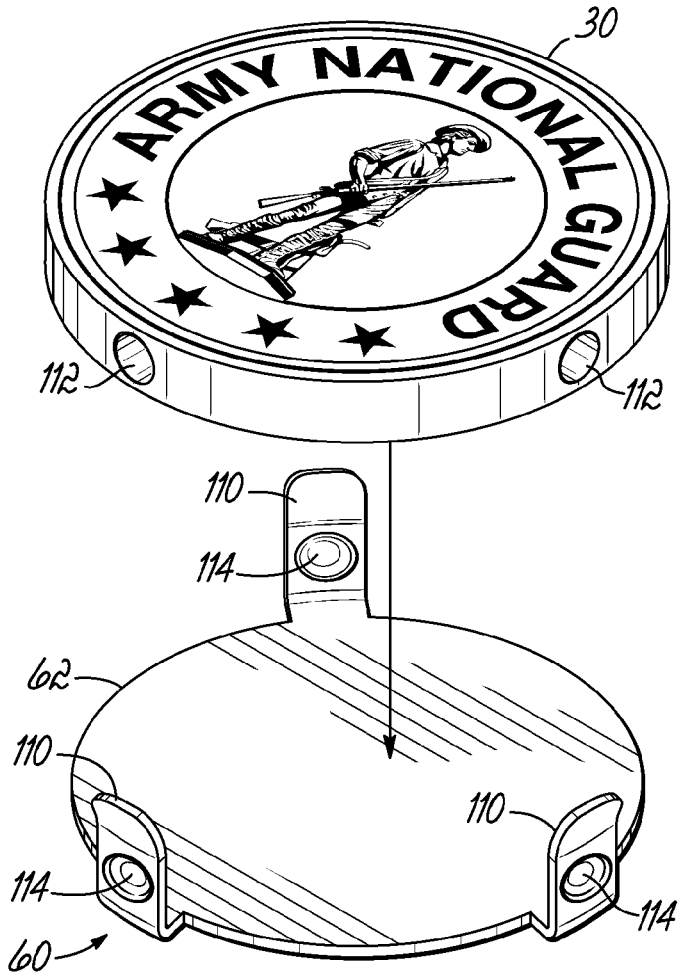
FIGS. 9A and 9B are exploded and assembled partial perspective views, respectively, of another embodiment of our casket.
Figure 9B:
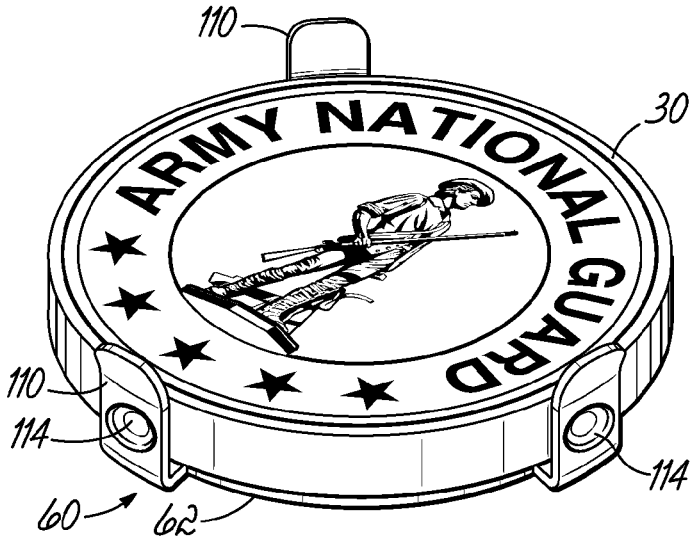

Referring to FIGS. 9A and 9B, the circular holder 62 can be a simple disk and have a plurality of resilient tabs 110 spaced circumferentially around the holder 62. The medallion 30 can be circular and can have a plurality of indents 112 spaced circumferentially around the medallion 30 which receive detents 114 on the resilient tabs 110.

Figure 10:
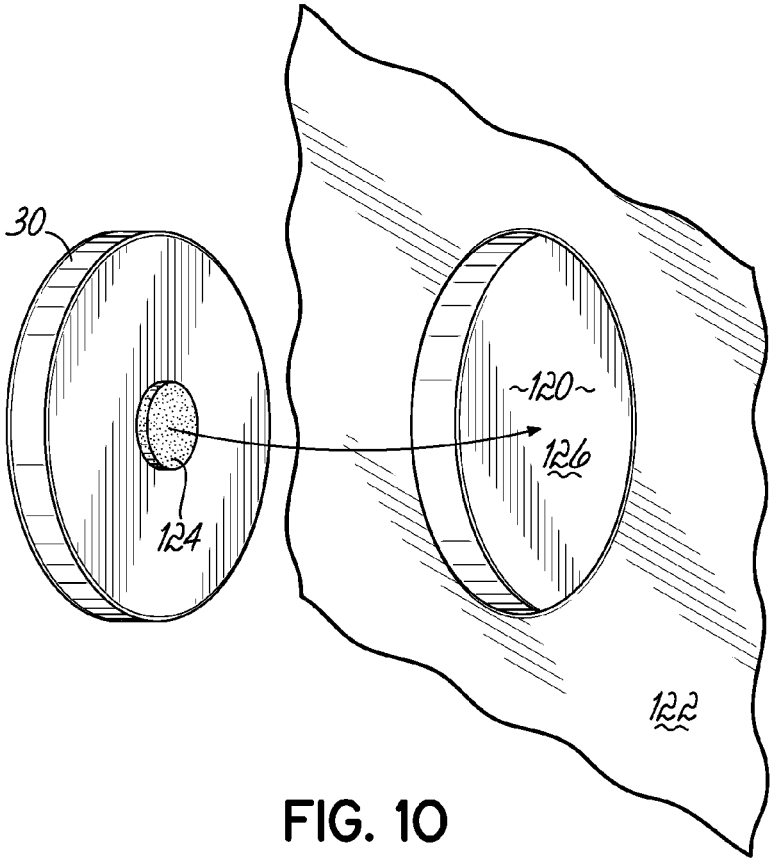
FIG. 10 is an exploded partial perspective view of another embodiment of our casket.

Referring to FIG. 10 medallion 30 can be circular and can fit into a matingly circular recess 120 in the surface 122 of either the cap panel or the shell or cap exterior. A magnet 124 can be used to secure the medallion 30 in the recess 120 by including magnetic material 126 in the recess 120 in the cap panel or she shell or cap exterior.

Figure 11A:
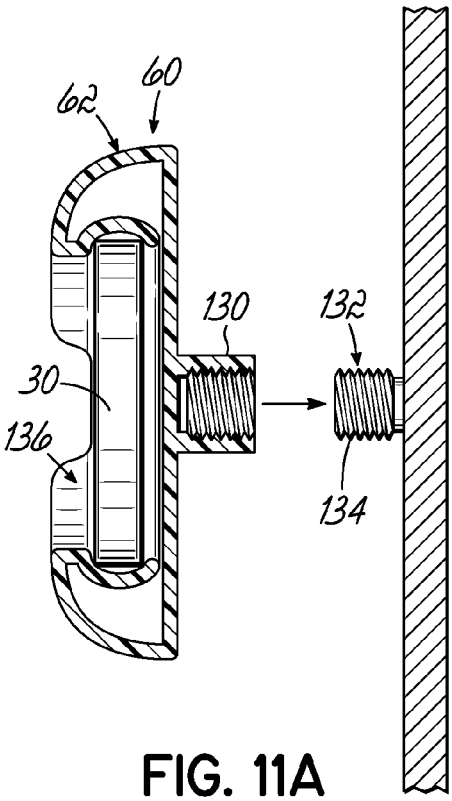
FIGS. 11A and 11B are exploded and assembled partial cross-sectional views, respectively, of another embodiment of our casket.
Figure 11B:
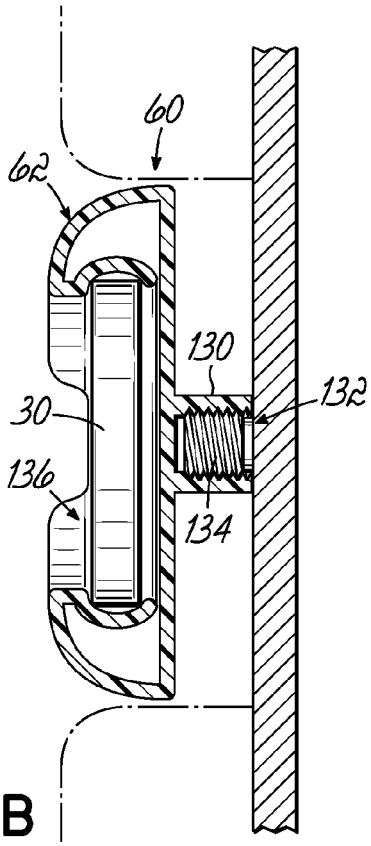

Referring to FIGS. 11A and 11B, receptacle 60 can comprise a resilient circular holder 62 having a female threaded fastener component 130 and a back piece 132 having a male threaded fastener component 134. The medallion 30 can be a snap-fit in a matingly shaped recess 136 in the resilient circular holder 62.

Figure 12:
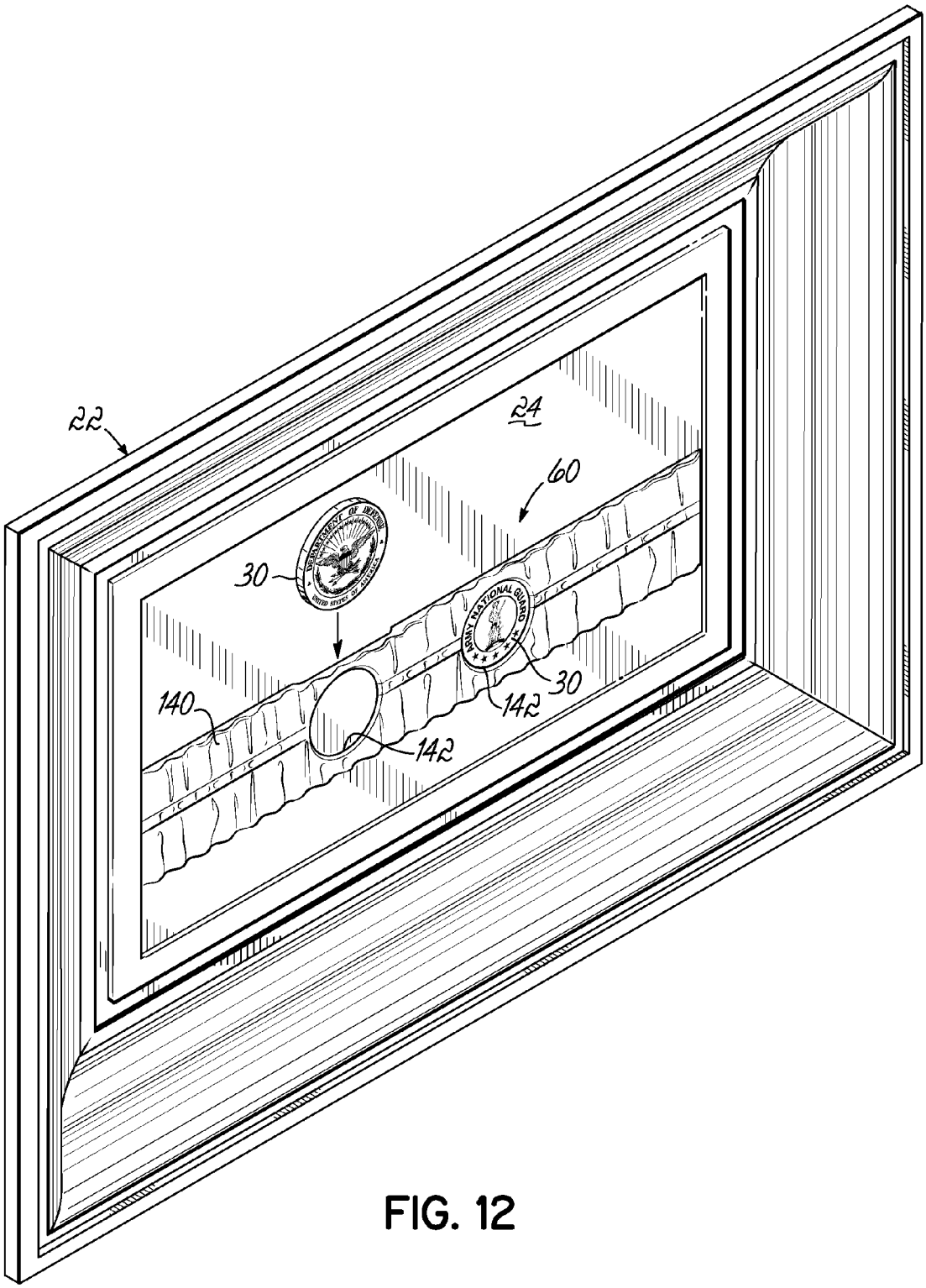
FIG. 12 is a partial perspective view of another embodiment of our casket.

Referring to FIG. 12, the receptacle 60 can comprise a decorative strip 140 attached to the cap panel 24 of a cap dish assembly 22. The decorative strip 140 can include an aperture 142 through which said medallion 30 is visible. The medallion 30 can be installed behind said strip 140 so as to be visible through the aperture 142.

Figure 13:
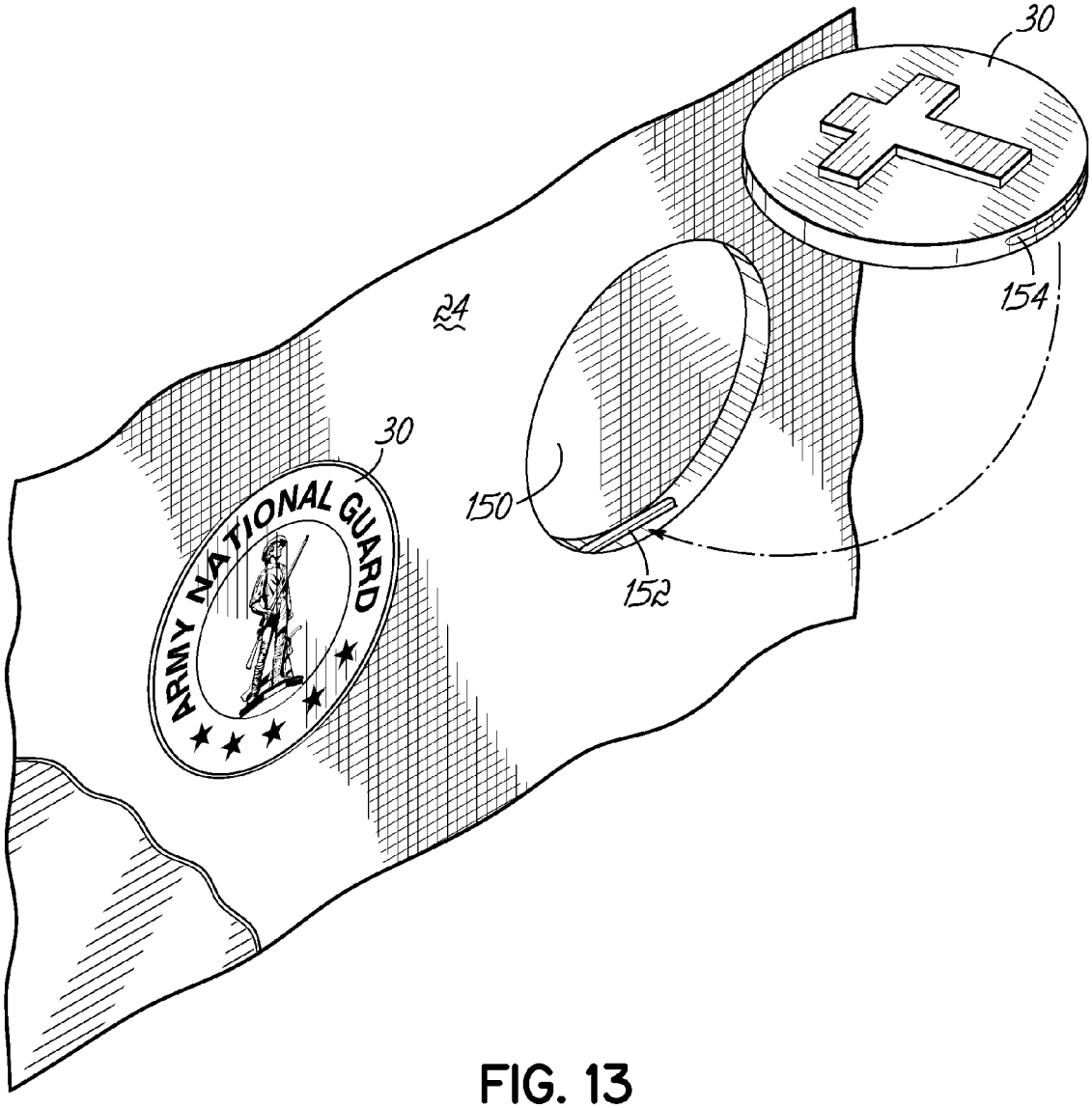
FIG. 13 is a partial perspective view of another embodiment of our casket.

Referring to FIG. 13, the receptacle 60 can be a circular recess 150 formed in the cap panel 24 and the medallion 30 can be a press-fit in the recess 150. The recess 150 can include a detent 152 at a lower edge thereof which is received in a peripheral slot 154 in a lower edge of the medallion 30.

Figure 14:
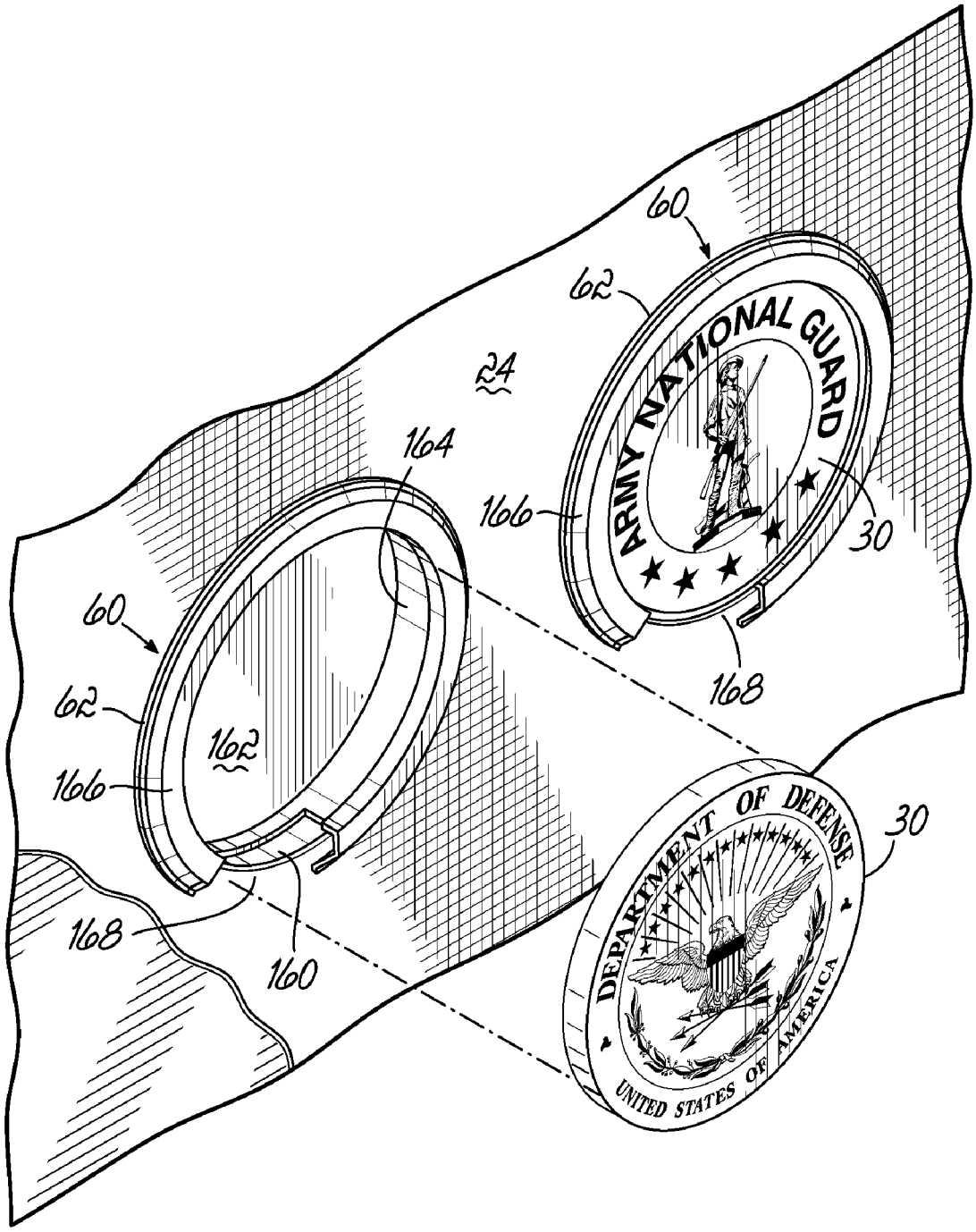
FIG. 14 is a partial perspective view of another embodiment of our casket.

Referring to FIG. 14, the receptacle 60 can be a circular holder 62 which is press fitted into a circular aperture 160 in cap panel 24. Holder 62 can have a bottom 162, a side wall 164, and a flange 166. The flange 166 and/or side wall 164 can be notched as at 168 to facilitate the placement and removal of the medallion 30 into and out of the holder 62.

Figure 15A:
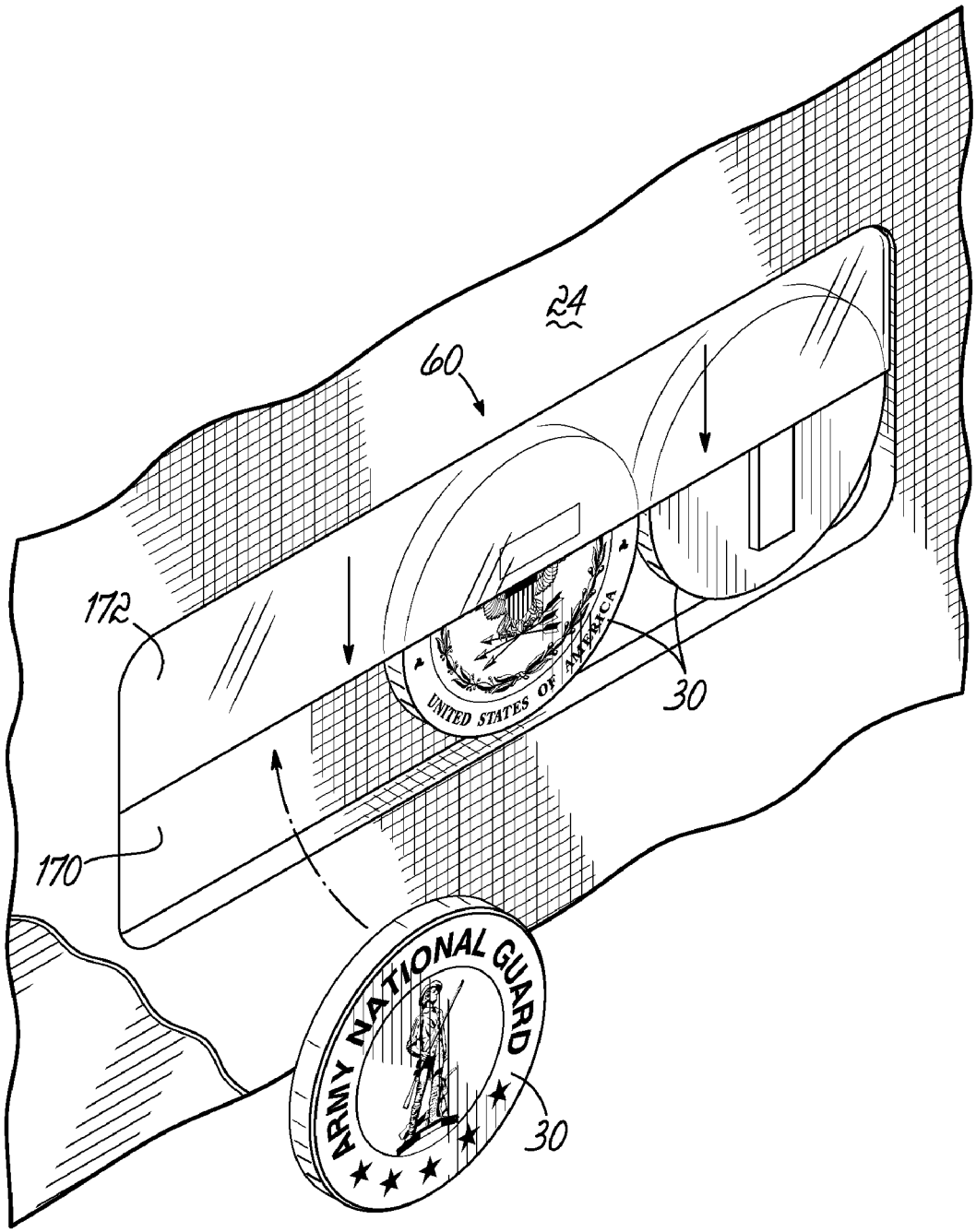
FIGS. 15A and 15B are exploded and assembled partial perspective views, respectively, of another embodiment of our casket.
Figure 15B:
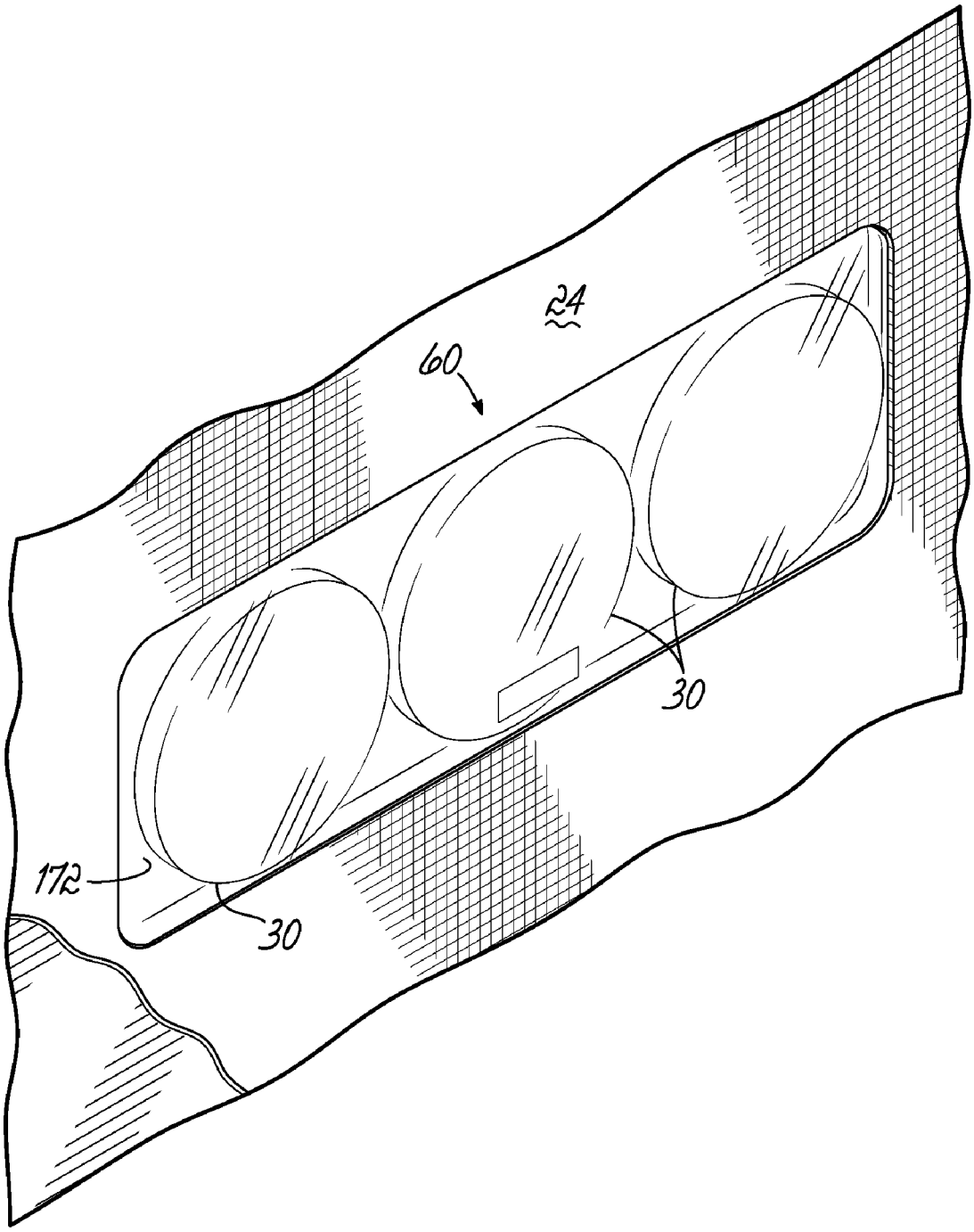

Referring to FIGS. 15A and 15B, the receptacle 60 can be a rectangular recess 170 formed in cap panel 24 and can include a sliding transparent sleeve 172 which covers the medallions 30 after being slipped into recess 170.

Figure 16:
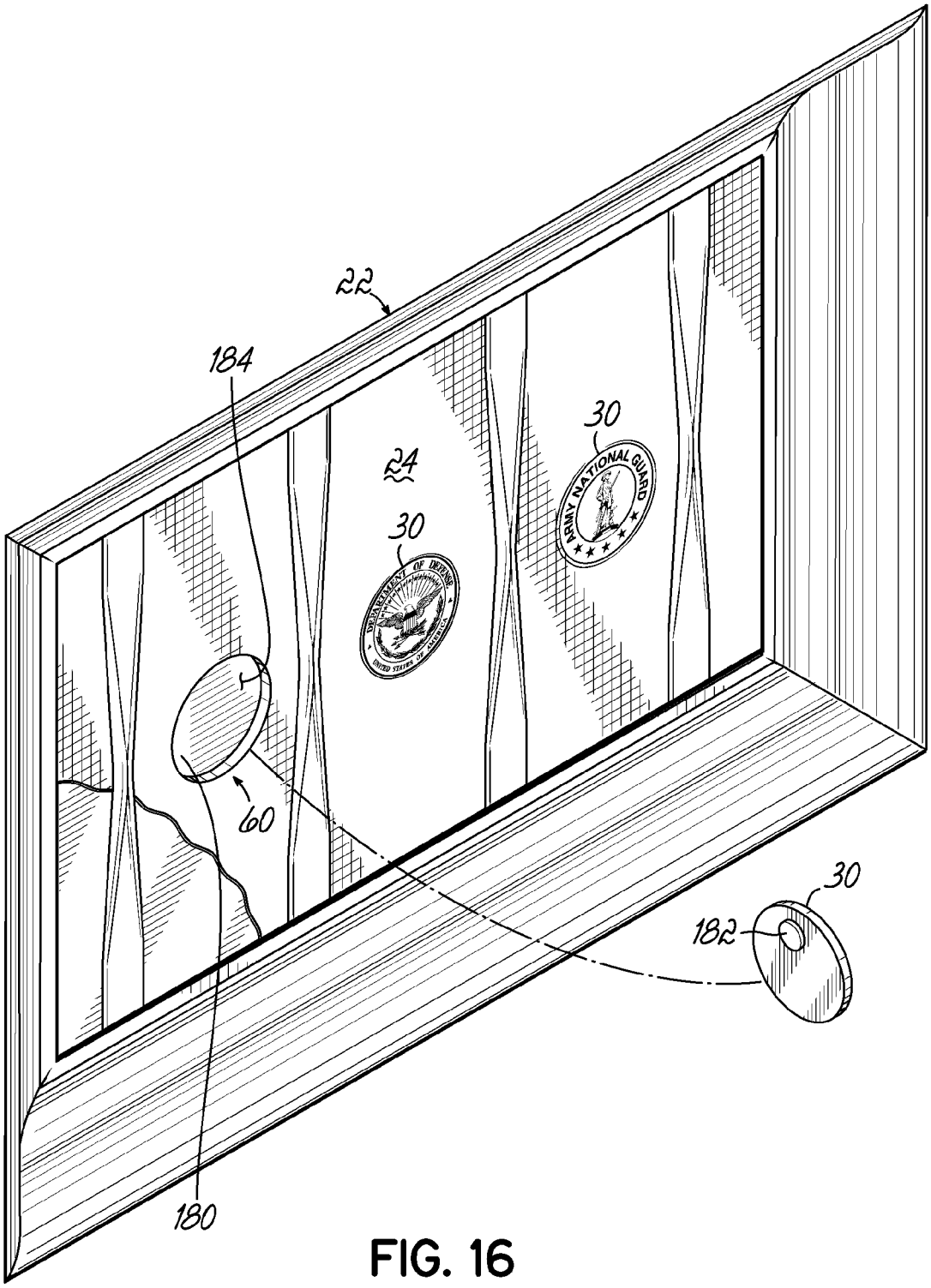
FIG. 16 is a partial perspective view of another embodiment of our casket.

Referring to FIG. 16, the receptacle 60 can be one or more circular recesses 180 formed in cap panel 24 of dish assembly 22 which receive one or more circular medallions 30 each having a magnet 182 on a rear side thereof. Cap panel 24 can include a magnetic material, for example steel, as a backer 184 to recesses 180 for magnet 182 to secure itself to.

Figure 17A:
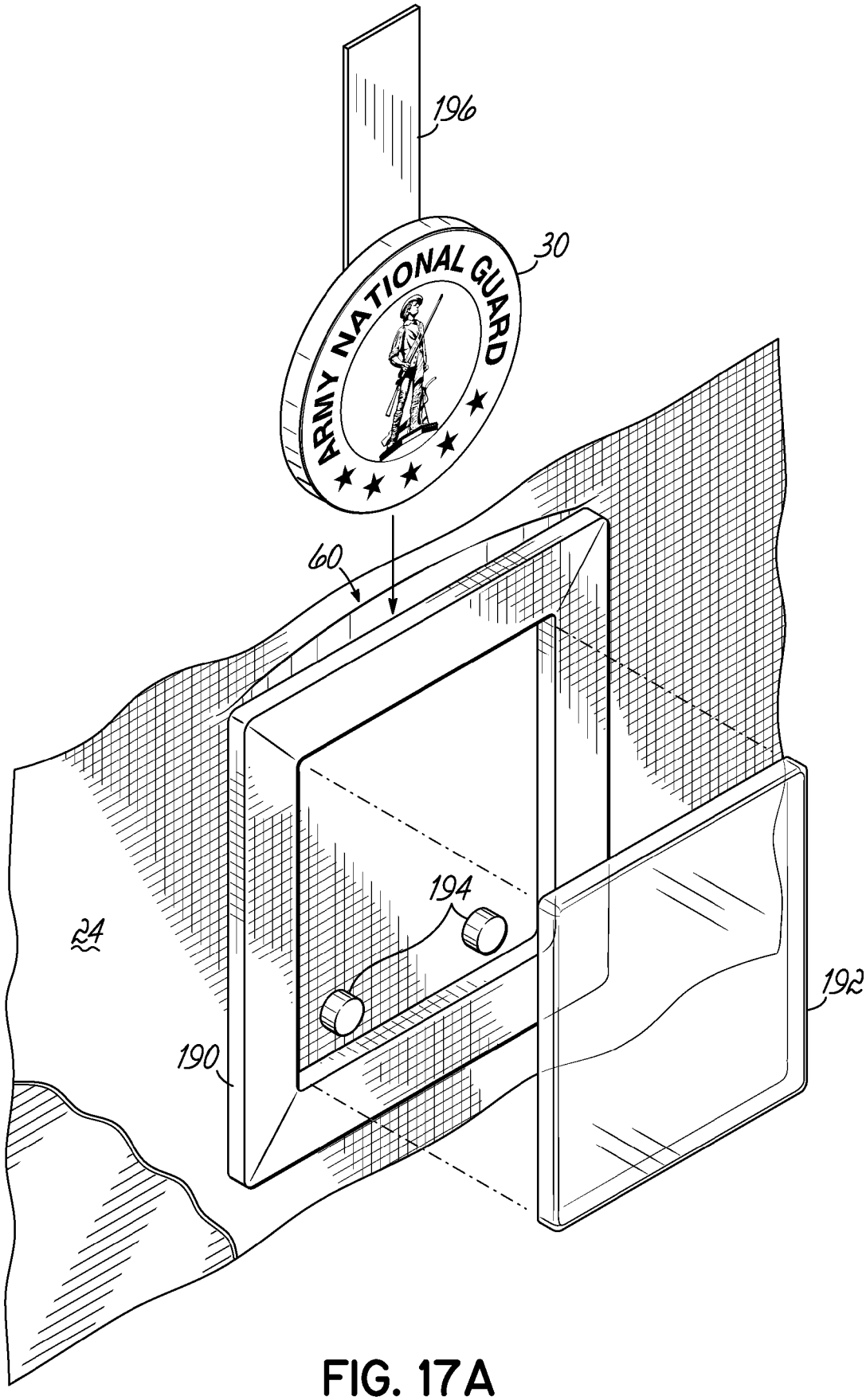
FIGS. 17A and 17B are exploded and assembled partial perspective views, respectively, of another embodiment of our casket.
Figure 17B:
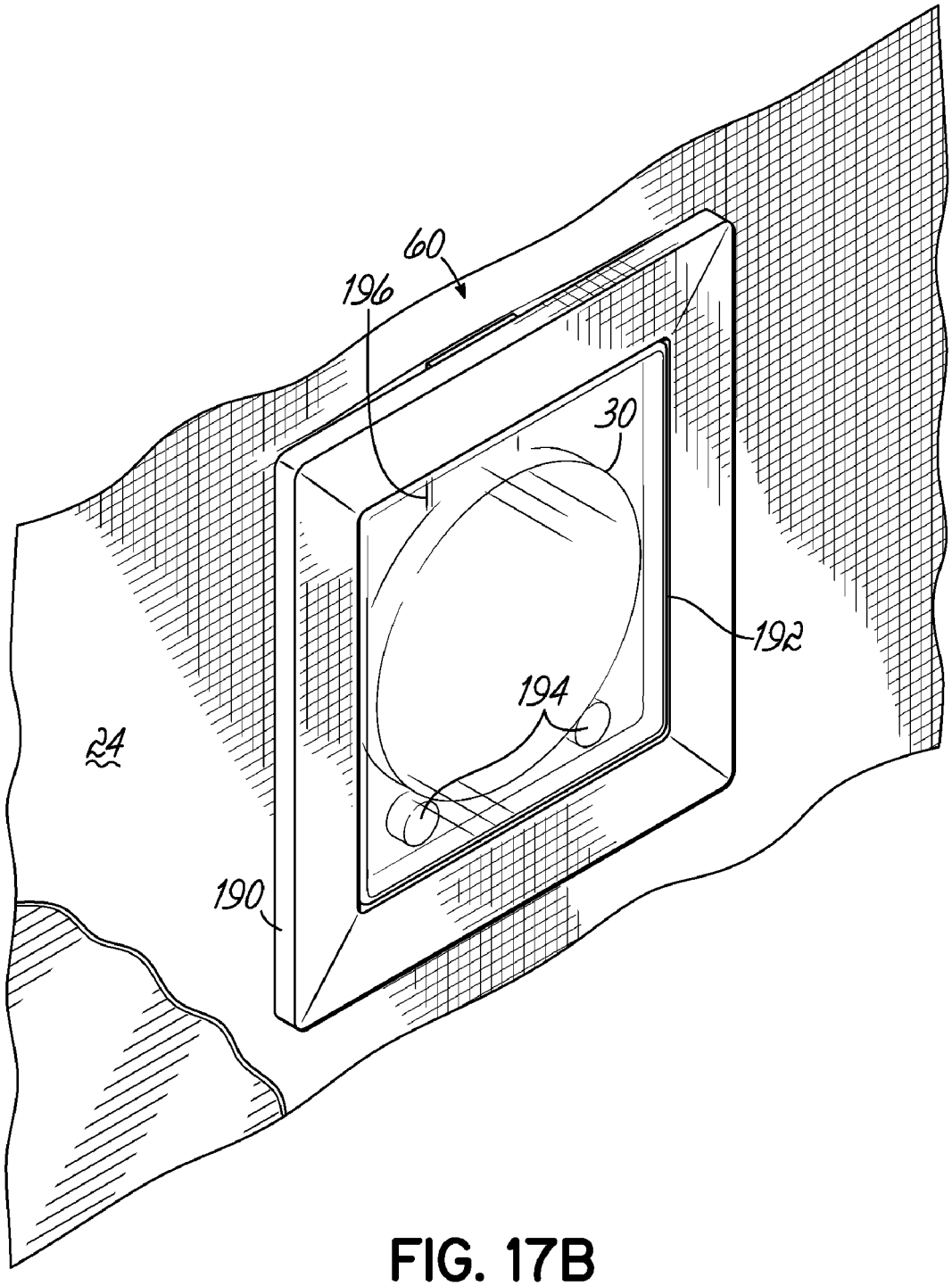

Referring to FIGS. 17A and 17B, the receptacle 60 can be a frame 190 mounted to cap panel 24 of dish assembly 22. Frame 190 can have a transparent front 192. A pair of pegs 194 can extend from the front surface of the cap panel 24 to or toward the back surface of the transparent front 192. The medallion 30 can be slipped into the frame 190 behind the transparent front 192 from a top of said frame 190. The medallion rests on the pegs 194 to properly position it within frame 190. A tab 196 can be attached to the medallion 30 to facilitate it's manipulation.

Figure 18:
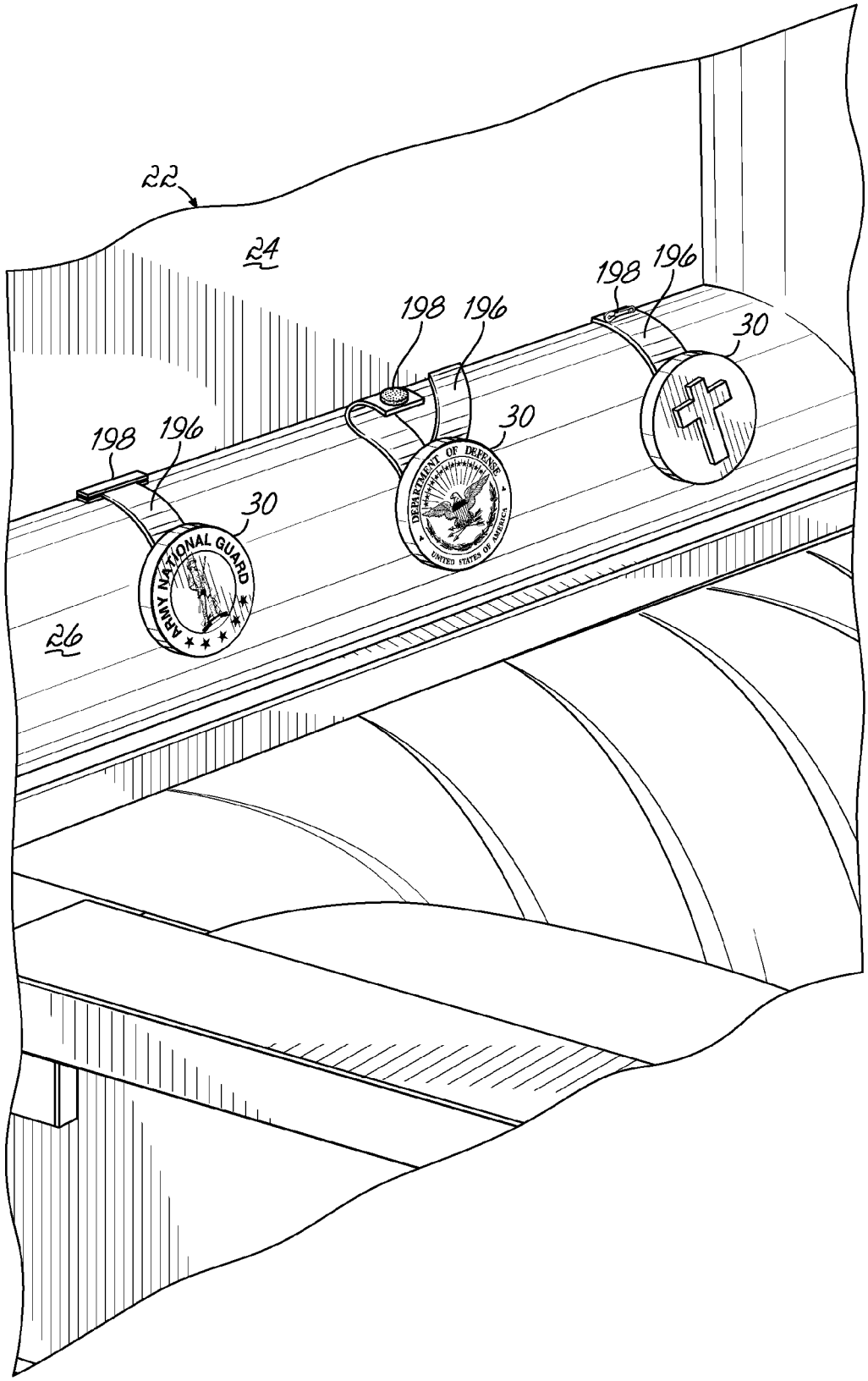
FIG. 18 is a partial perspective view of another embodiment of our casket.

Referring to FIG. 18, the medallions 30 include a tab or ribbon 196 attached thereto which can be is attached to a lower puffing 26 of said dish assembly 22 by a fastener 198 such as tape, double sided tape, magnets, hook and loop, pins, adhesives, or the like.

Figure 19A:
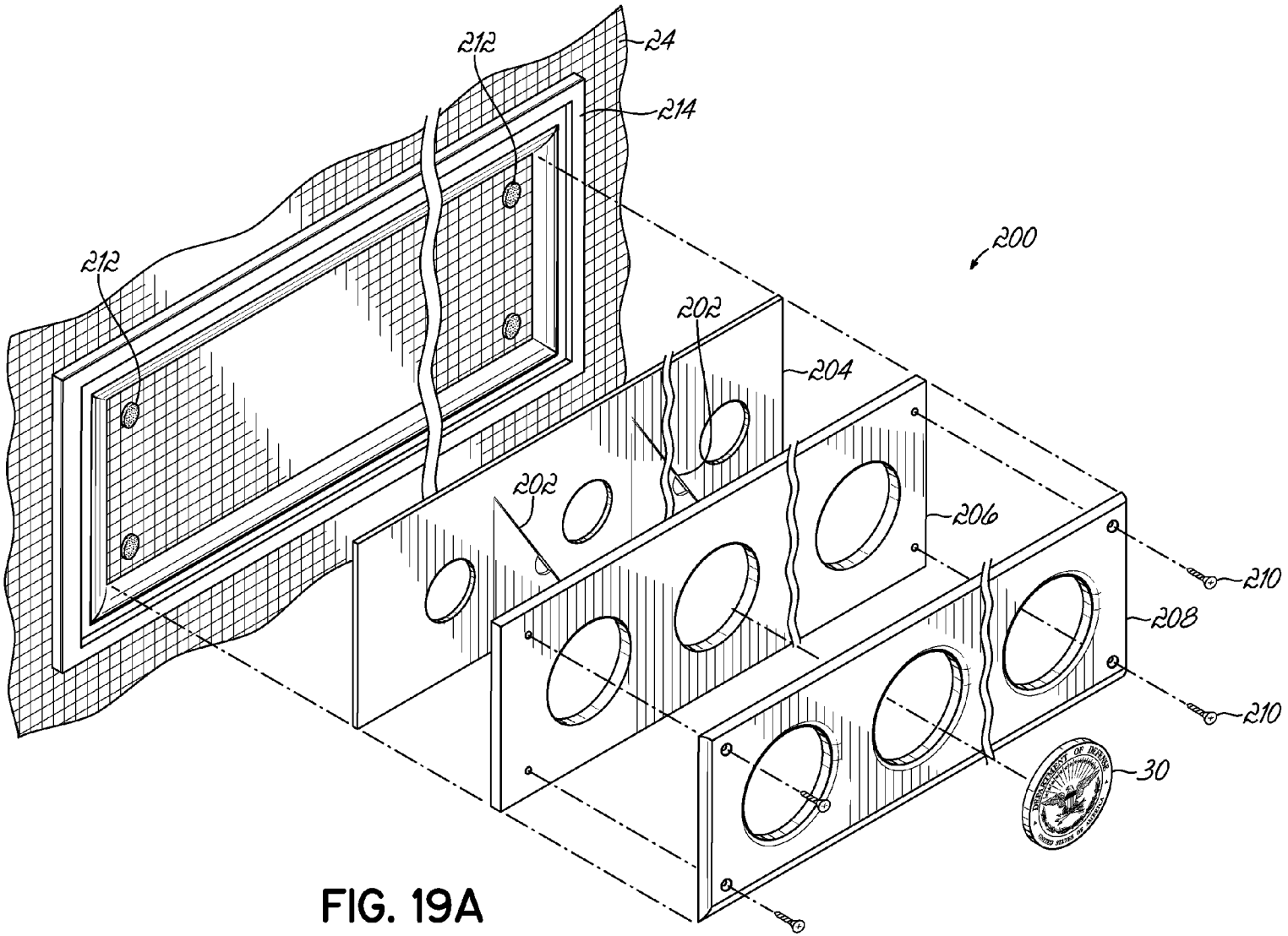
FIGS. 19A and 19B are exploded and assembled partial perspective views, respectively, of another embodiment of our casket.
Figure 19B:
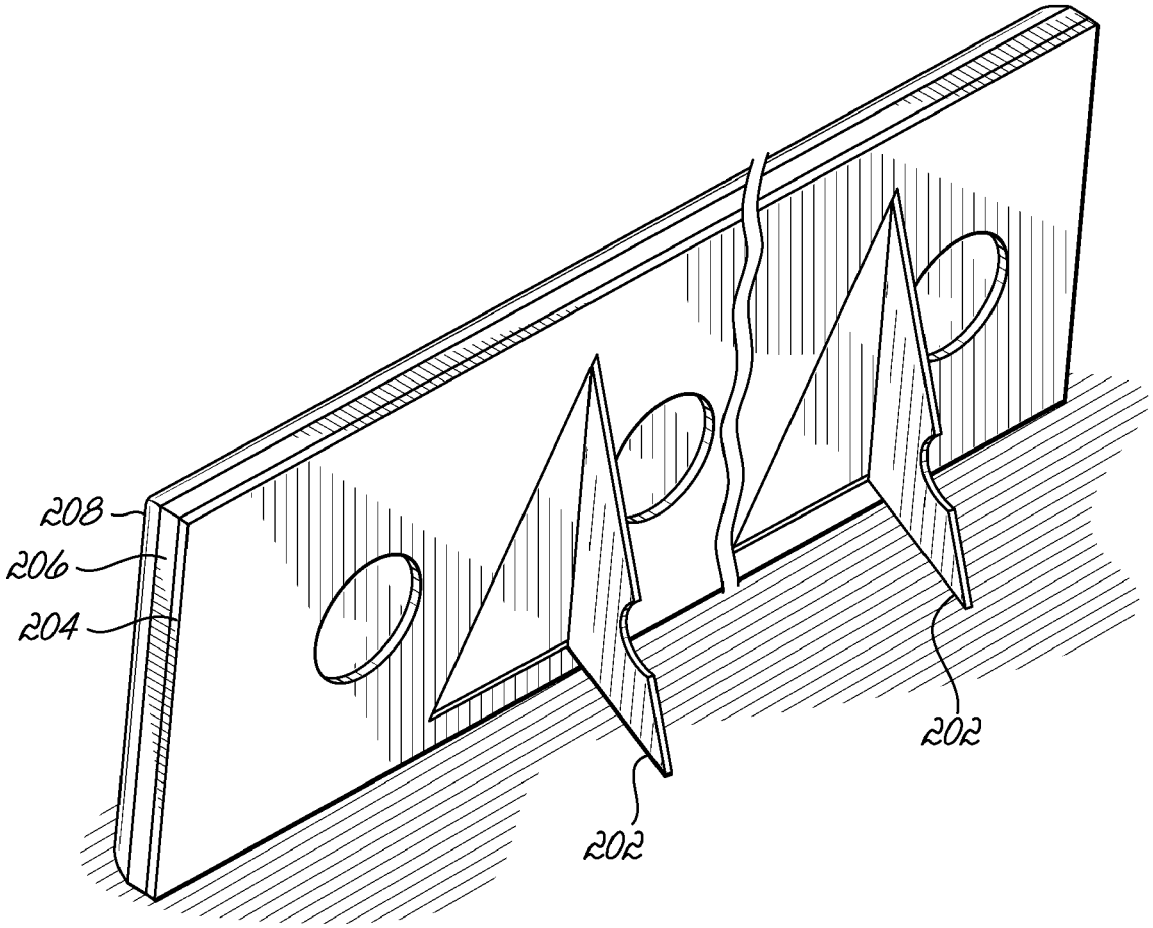

Referring to FIGS. 19A and 19B, the medallions 30 can be mounted in a frame 200 which is removably attached to the cap panel 24. The frame 200 can have means, for example folding legs 202, on a rear side thereof to stand the frame 200 on a surface for display. Frame can have a back panel 204 from which legs 202 are die cut and folded, an intermediate panel 206 for receiving medallions 30, and a decorative outer panel or frame 208, all secured together with screws 210. Hook and loop 212 can be used to removably secure frame 200 to cap panel 24. A further decorative frame or border 214 can be mounted to cap panel 24 which would removably receive the frame 200.

Figure 20:
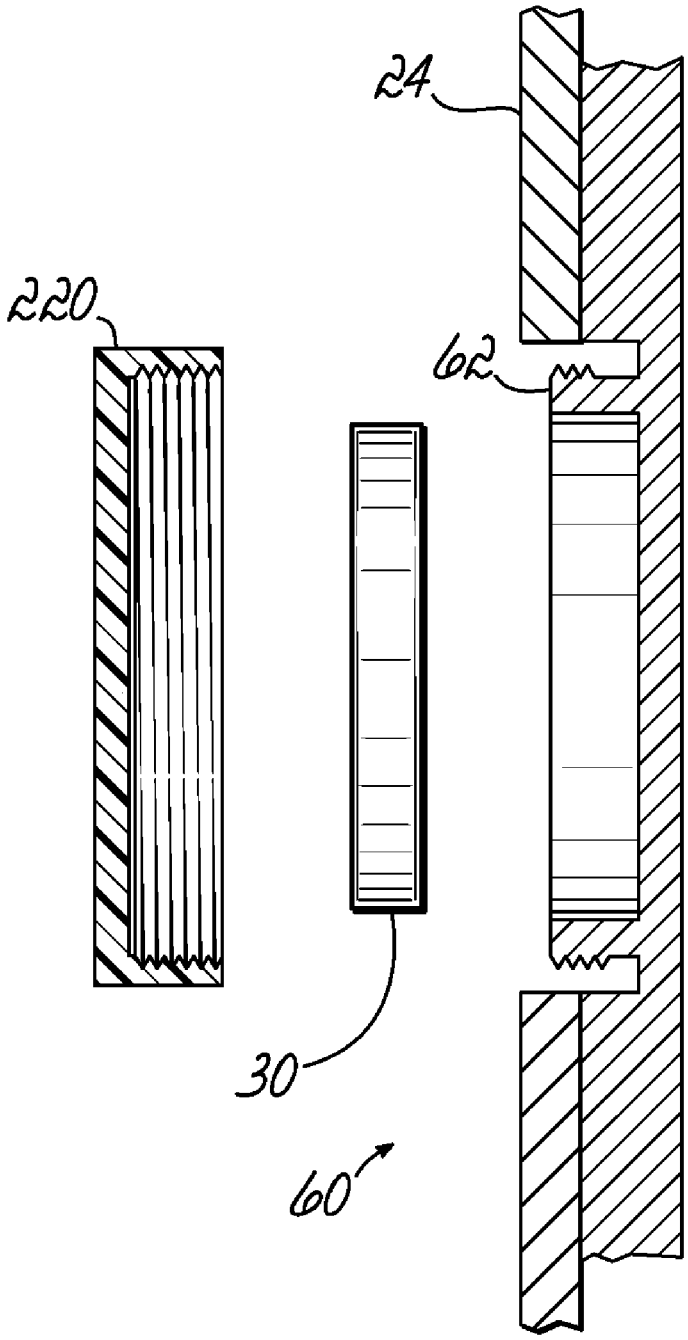
FIG. 20 is a partial cross-sectional view of another embodiment of our casket.

Referring to FIG. 20 the receptacle 60 can be a circular holder 62 to which is threadably attached a transparent lens 220.

Figure 21:
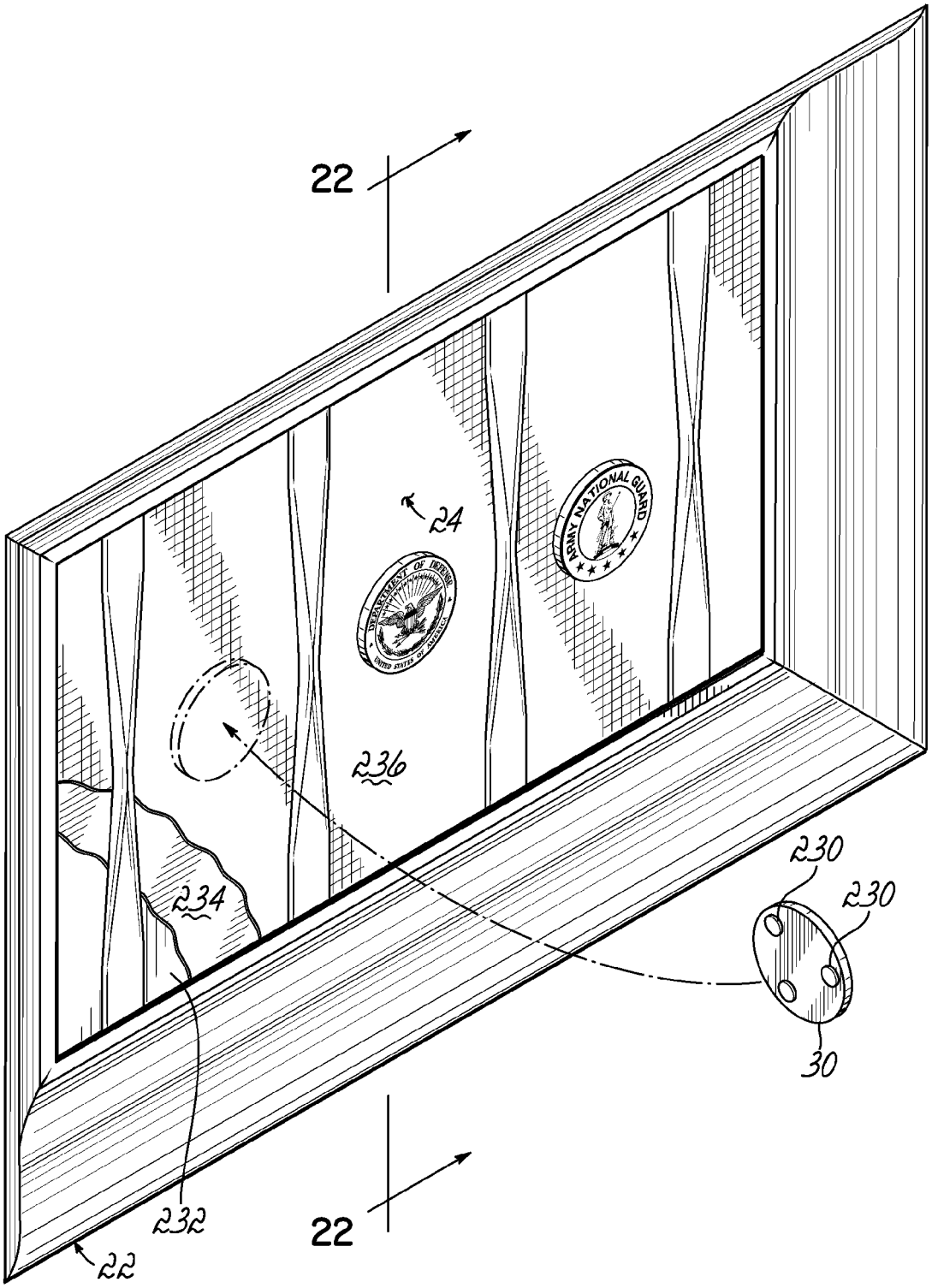
FIG. 21 is a partial perspective view of another embodiment of our casket.
Figure 22:
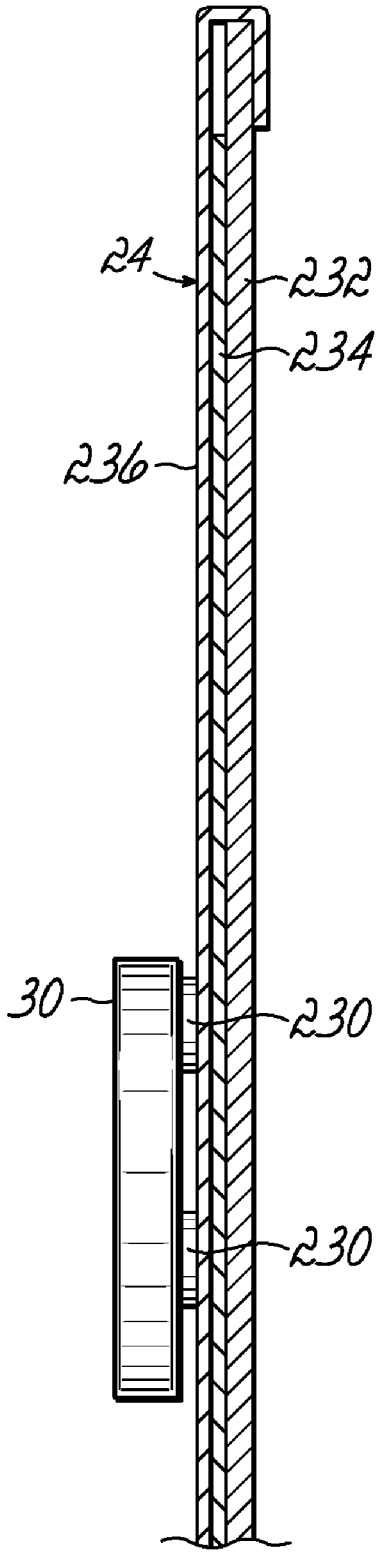
FIG. 22 is a cross-sectional view taken along line 22-22 in FIG. 21.

Referring to FIGS. 21 and 22, the dish assembly 22 is constructed in such a way as to permit medallions 30 to be placed anywhere on the cap panel 24. In this embodiment each of the medallions has one or more magnets 230 on a rear side thereof. The cap panel 24 is fabricated from a sheet of cardboard or chipboard 232 over which is placed a sheet of magnetic material 234, for example steel. The sheet of magnetic material 234 is then covered with a sheet of decorative material 236. Since the entire surface area of the cap panel 24 is magnetic material, medallions 30 can be placed anywhere within the surface area of the cap panel 24, i.e. they do not have to be placed within a designated receptacle. This permits more freedom in placing and arranging medallions as desired by the funeral director, and/or family, friends, and/or loved ones of the deceased.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. Accordingly, the scope of the right to exclude shall be limited only by the following claims and their equivalents.

What is claimed is:

1. A casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, and at least one medallion mounted on one of an interior surface of one of said cap and said shell and an exterior surface of one of said cap and said shell, said medallion having at least one of text and graphics representing a life aspect of the deceased, said medallion being generally planar and having a transverse dimension and a thickness dimension, said transverse dimension being substantially less than a height dimension and a width dimension of said cap panel, said thickness dimension being substantially less than said transverse dimension;

further comprising a reduced scale medallion corresponding to said at least one medallion, said reduced scale medallion having substantially the same shape, text, and graphics of said medallion, said reduced scale medallion being sized to fit in a pocket of an article of clothing worn by a loved one of the deceased.

2. The casket of claim 1 wherein said reduced scale medallion is about the size and shape of a coin.

3. A method of memorializing a deceased comprising the steps of:

displaying the deceased in a casket having a cap with a cap panel and a shell and further having at least one medallion mounted on one of an interior surface of one of the cap and the shell and an exterior surface of one of the cap and the shell, the medallion having at least one of text and graphics representing a life aspect of the deceased, the medallion being generally planar and having a transverse dimension and a thickness dimension, the transverse dimension being substantially less than a height dimension and a width dimension of the cap panel, the thickness dimension being substantially less than the transverse dimension, and presenting a survivor of the deceased with a reduced scale medallion corresponding to the medallion, the reduced scale medallion having substantially the same shape, text, and graphics of the medallion, the reduced scale medallion being sized to fit in a pocket of an article of clothing worn by the survivor of the deceased.

4. The method of claim 3 wherein the reduced scale medallion is about the size and shape of a coin.

5. The method of claim 3 wherein the cap includes a dish assembly mounted to an underside of the cap, the dish assembly includes said cap panel, and the medallion is mounted in a recess in the cap panel.

6. The method of claim 3 wherein the medallion is mounted in a recess in the exterior surface of the cap.

7. The method of claim 3 further including the step of engraving a rear side of the reduced scale medallion, prior to presenting the reduced scale medallion to the survivor, with the name and birth and death dates of the deceased.

8. A casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, said cap panel comprising a sheet of magnetic material, and at least one medallion having a magnet on a rear side mounted on said cap panel, said medallion having at least one of text and graphics representing a life aspect of the deceased.

9. The casket of claim 8 wherein said dish assembly includes puffing members mounted around a periphery thereof, wherein said cap panel further comprises a cardboard or chipboard backing sheet, said sheet of magnetic material being placed on top of said backing sheet, and wherein said cap panel further comprising decorative fabric covering said magnetic sheet.

10. The casket of claim 9 wherein said magnetic material sheet covers substantially an entire surface area bounded by said puffing members.

11. A casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel and puffing members mounted around a periphery of said cap panel, said cap panel comprising a sheet of magnetic material, and at least one magnetic ornament on said cap panel.

12. The casket of claim 11 wherein said magnetic material sheet covers substantially an entire surface area bounded by said puffing members.

13. The casket of claim 12 wherein said cap panel further comprises a cardboard or chipboard backing sheet, said sheet of magnetic material being placed on top of said backing sheet, and wherein said cap panel further comprising decorative fabric covering said magnetic sheet.

14. The casket of claim 11 wherein said ornament is a medallion.

* * * * *